US010156088B2

(12) United States Patent
Bullwinkel et al.

(10) Patent No.: US 10,156,088 B2
(45) Date of Patent: Dec. 18, 2018

(54) LOCKING DEVICE FOR PRODUCT DISPLAY HOOKS, SHOWCASES, CABINETS, FIXTURES, AND CASEWORK

(71) Applicant: Delta Lock Company, LLC, Bohemia, NY (US)

(72) Inventors: William H. Bullwinkel, Farmingdale, NY (US); Pasquale J. Luongo, IV, West Hempstead, NY (US)

(73) Assignee: Delta Lock Company, LLC, Bohemia, NY (US)

( * ) Notice: Subject to any disclaimer, the term of this patent is extended or adjusted under 35 U.S.C. 154(b) by 293 days.

(21) Appl. No.: 15/095,086

(22) Filed: Apr. 10, 2016

(65) Prior Publication Data

US 2016/0281393 A1 Sep. 29, 2016

Related U.S. Application Data

(63) Continuation-in-part of application No. 14/607,595, filed on Jan. 28, 2015, now Pat. No. 9,435,144.

(60) Provisional application No. 62/145,533, filed on Apr. 10, 2015.

(51) Int. Cl.
*E05B 67/36* (2006.01)
*A47F 5/08* (2006.01)

(52) U.S. Cl.
CPC ..... *E05B 67/36* (2013.01); *A47F 5/0861* (2013.01); *Y10T 70/7486* (2015.04); *Y10T 70/7576* (2015.04)

(58) Field of Classification Search
CPC ..... E05B 67/36; E05B 21/06; E05B 73/00; E05B 65/06; A47F 5/0861; Y10T 70/7486; Y10T 70/50; Y10T 70/5004; Y10T 70/7576; Y10T 70/7582
USPC ..... 70/14, 57.1; 211/4, 7, 54.1, 57.1, 59.1
See application file for complete search history.

(56) References Cited

U.S. PATENT DOCUMENTS

| | | | |
|---|---|---|---|
| 1,342,728 | A | 6/1920 | Welch |
| 1,539,301 | A | 5/1925 | Cooper |
| 1,965,336 | A | 7/1934 | Fitzgerald |
| 2,032,821 | A | 3/1936 | Carral |
| 3,340,709 | A | 9/1967 | Callahan |
| 3,696,647 | A | 10/1972 | Balicki |

(Continued)

FOREIGN PATENT DOCUMENTS

WO WO8300353 2/1983

*Primary Examiner* — Lloyd A Gall
(74) *Attorney, Agent, or Firm* — Gerald E. Hespos; Michael J. Porco; Adam Hotzoglou

(57) ABSTRACT

A locking device that may be used with display hooks is provided. The locking device includes a housing and a shell. A pivoting member is coupled to the housing. The pivoting member may be pivoted to grasp a peg or display hook in a cylindrical channel formed by the housing and the pivoting member. The shell includes a projection that is at least partially disposed within the interior of the housing and is movable in a longitudinal direction within the interior of the housing. In an unlocked position, the projection is biased away from the channel in the housing. In a locked position, the projection passes through an aperture in the pivoting member, holding the pivoting member in a stationary position relative to the housing. Further, in the locked position, the projection may secure the peg hook in the cylindrical channel formed by the housing and the pivoting member.

19 Claims, 41 Drawing Sheets

(56) References Cited

U.S. PATENT DOCUMENTS

| | | | | |
|---|---|---|---|---|
| 3,726,115 | A * | 4/1973 | Wellekens | E05B 67/26 70/33 |
| 3,863,475 | A | 2/1975 | Foss | |
| 3,933,015 | A | 1/1976 | Balicki | |
| 4,009,599 | A | 3/1977 | Patriquin | |
| 4,418,554 | A | 12/1983 | Wolfgang | |
| 4,476,699 | A | 10/1984 | Dahlborg | |
| 4,565,080 | A | 1/1986 | Kincaid | |
| 4,793,163 | A * | 12/1988 | MacFarlane | E05C 19/08 16/374 |
| 4,899,563 | A | 2/1990 | Martin | |
| 4,920,774 | A | 5/1990 | Martin | |
| 5,038,589 | A | 8/1991 | Martin | |
| 5,121,619 | A | 6/1992 | Martin | |
| 5,127,244 | A | 7/1992 | Myers | |
| 5,255,544 | A | 10/1993 | Wu | |
| 5,345,794 | A | 9/1994 | Jenks | |
| 5,492,206 | A | 2/1996 | Shieh | |
| 5,499,518 | A | 3/1996 | Shieh | |
| 5,657,652 | A | 8/1997 | Martin | |
| 5,722,275 | A | 3/1998 | Price | |
| 5,737,950 | A | 4/1998 | Yun-Bin | |
| 5,819,889 | A | 10/1998 | Shieh | |
| 5,913,907 | A | 6/1999 | Lee | |
| 6,035,673 | A | 3/2000 | Harrison | |
| 6,092,402 | A | 7/2000 | Porcelli | |
| 6,920,770 | B2 | 7/2005 | Lurie et al. | |
| 7,308,809 | B2 | 12/2007 | Lu | |
| RE41,188 | E | 4/2010 | Lurie | |
| 7,695,031 | B2 | 4/2010 | Jackson, Jr. | |
| 7,716,958 | B2 | 5/2010 | Martin | |
| 7,849,720 | B2 | 12/2010 | Reese | |
| 7,874,189 | B2 | 1/2011 | Martin | |
| 7,918,111 | B2 | 4/2011 | Uliano | |
| 8,028,555 | B2 | 10/2011 | Lurie | |
| 8,646,297 | B2 | 2/2014 | Foti | |
| 8,776,557 | B2 | 7/2014 | Wang | |
| 8,919,156 | B1 | 12/2014 | Liu | |
| 8,978,426 | B2 | 3/2015 | Wang | |
| 9,167,918 | B2 * | 10/2015 | Leyden | A47F 5/0861 |
| 9,435,144 | B2 * | 9/2016 | Bullwinkel | E05B 73/00 |
| 2001/0045114 | A1 | 11/2001 | Sokurenko | |
| 2005/0011237 | A1 | 1/2005 | Lurie | |
| 2005/0011239 | A1 | 1/2005 | Lurie et al. | |
| 2005/0241348 | A1 | 11/2005 | Devecki | |
| 2005/0279894 | A1 * | 12/2005 | Sedon | A47F 5/0823 248/175 |
| 2006/0157431 | A1 * | 7/2006 | Nagelski | A47F 5/0861 211/54.1 |
| 2007/0175246 | A1 | 8/2007 | Hsai | |
| 2009/0071209 | A1 | 3/2009 | Lurie | |
| 2010/0031717 | A1 | 2/2010 | Lurie et al. | |
| 2010/0212371 | A1 | 8/2010 | Foti | |
| 2013/0105419 | A1 | 5/2013 | Kologe | |
| 2014/0013813 | A1 | 1/2014 | Le | |
| 2014/0298869 | A1 | 10/2014 | Wang | |
| 2015/0176307 | A1 | 6/2015 | Bullwinkel | |

* cited by examiner

LOCKING DEVICE FOR PRODUCT DISPLAY HOOKS, SHOWCASES, CABINETS, FIXTURES, AND CASEWORK

PRIORITY

The present application is a Continuation-In-Part Application of U.S. application Ser. No. 14/607,595, filed Jan. 28, 2015, now U.S. Pat. No. 9,435,144, the entire contents of which are incorporated by reference herein.

The present application also claims priority to U.S. Provisional Patent Application Ser. No. 62/145,533 filed Apr. 10, 2015, entitled "LOCKING DEVICE FOR PROUCT DISPLAY HOOKS, SHOWCASES, CABINETS, FIXTURES AND CASEWORK", the contents of which are hereby incorporated by reference in its entirety.

TECHNICAL FIELD

The present disclosure relates generally to devices and systems for preventing unauthorized removal of goods from a product display, fixture or the like, and more particularly, a locking device for product display hooks, showcases, cabinets, casework, and fixtures with doors, drawers and sliding doors.

BACKGROUND

Conventionally, items of merchandise are commonly displayed for sale on long protruding rods supported from a support structure in the nature of a peg board, a slat board, or a wire rack. These protruding rods are commonly referred to in the art as display hooks, peg board hooks, or slat board hooks. Similar rods may also protrude from a wire display rack for the same purpose.

The rods may come in a variety of shapes and sizes. For example, FIG. 1A illustrates a display hook or peg hook 10 formed from a single wire 12 with a single bend 14 at one end 16, while FIG. 1B illustrates a similar peg hook 10 with a ball end 18. The other end 20 of the peg hook 10 is configured to be coupled to a peg board (not shown).

In another example as shown in FIG. 1C, display hooks or peg hooks 22, 24 are formed of wire and are provided with upper and lower outwardly extending wire arms 26, 28, respectively. The upper arm 26 mounts a label holder 30 for holding a label that includes pricing and other product information, while the lower arm 28 is a display hook or peg hook. After the peg hook 10, 22, 24 is coupled to the peg board or other support structure, consumer goods or items are slid onto the wire 12 or lower arm 28 for display. Typically, merchandise can be packaged in or mounted on cardboard, plastic, or other material capable of supporting the weight of the merchandise. The packaging materials may include a hole, slot, or opening, generally near the top of the packaging, to receive the projecting wire of the display hook or peg hook 10, 22, 24. In this way, the merchandise hangs down from the wire 12 or lower arm 28 and is clearly displayed and easily removed by customers.

In a further example, FIG. 1D illustrates a double wire peg hook 32, also known as a loop hook or display hook. In this example, a single wire 34 is configured in an elongated U-shape forming one loop or bend 36 at one end 38. The other end 40 includes two free ends 42, 44 of the U-shaped wire 34, which are configured to mate with a respective support structure, such as a peg board, slat board, etc. For use with the loop hook 32, the item or merchandise is typically packaged in or mounted on cardboard, plastic, or other material with an elongated slot or opening configured to accept the bend 36 of the peg hook 32.

Items of merchandise may also be displayed and stored behind doors, drawers, showcases, cabinets, casework, and sliding doors in store fixtures.

Usually, hanging merchandise is relatively small but may be expensive, such as batteries, small tools, jewelry, cosmetic products, health care products, electronics and other high theft items. Such merchandise may be a target for shoplifters because of its relatively small size and easy accessibility. A shoplifter may be able to easily and quickly remove the items hanging from a display hook or displayed in unlocked showcase doors, drawers, or sliding doors, and then attempt to leave the store without being detected.

Therefore, a need exists for devices and systems that prevent the easy removal of items of merchandise, such as small expensive items, from display hooks, showcases, cabinets, casework, and fixtures with doors, drawers, and sliding doors.

SUMMARY

A locking device for product display hooks, showcase doors, drawers, and sliding doors is provided.

A locking device according to one embodiment comprises an outer housing, which includes an outer wall and a hollow cylindrical interior, the hollow cylindrical interior having a first longitudinal axis. The outer housing includes a first peg groove. A pivoting member is coupled to the outer housing via a hinging mechanism, such that, the pivoting member may pivot about the hinging mechanism coupling the pivoting member to the outer housing to achieve an open and closed position. The pivoting member includes a lug, the lug including an aperture at the center of the lug. The pivoting member also includes a second peg groove. When the pivoting member is pivoted such that the pivoting member is in a closed position relative the outer housing, the first peg groove in the outer housing and the second peg groove in the pivoting member form a channel extending therethough to grasp or lock onto a cylindrical wire, e.g., a peg hook. In certain embodiments, an extension member protrudes from each side of the channel formed by the combined outer housing and pivoting member.

The locking device further comprises a cylindrical shell including a projection. The cylindrical shell is at least partially disposed in the interior of the outer housing and moveable within the interior along the first longitudinal axis. The locking device also includes a cylinder plug having a key hole and tumblers. The cylinder plug is rotatably contained within the cylindrical shell. Additionally, the locking device includes a barrel spring at least partially contained within the interior of the outer housing. The barrel spring is configured to bias the projection of the cylindrical shell away from the outer housing to an unlocked position.

The outer housing is configured to receive a wire in the first peg groove, where the wire can be secured in the channel formed by the first and second peg groove when the pivoting member is pivoted about the hinge to achieve a closed position relative to the outer housing. In this closed position, the projection is extended toward the outer housing where the projection passes through the aperture in the lug to achieve a locked position. In the locked position, the pivoting member can no longer pivot about the hinge since the projection is holding the lug in a stationary position, and thus holding the pivoting member in a closed position. Therefore, in the locked position, the wire is secured in the channel formed by the first peg groove in outer housing and the second peg groove in the pivoting member while the pivoting member is in the closed position relative to the outer housing.

In yet another embodiment, a push (or plunger type) actuated lock is provided. The push actuated lock of the present disclosure may be coupled to multiple peg styles including, but not limited to: single wire with bend of multiple angles, single wire with bend of multiple angles with ball end, double wire with bend of multiple angles, double wire with bend of multiple angles with ball end, etc.

In a further embodiment, a locking device includes a housing having a first end and a second end, the first end including a hollow cylindrical interior having a first longitudinal axis along the housing, the second end including a groove traversing the first longitudinal axis, the groove configured to receive at least a portion of a wire; a cylindrical shell including a projection, the cylindrical shell being at least partially disposed in the interior of the housing and moveable within the interior along the first longitudinal axis; and a pivoting member hingedly coupled to the second end of the housing by a hinging mechanism, wherein in an open position, the pivoting member is spaced away from the groove, in a closed position, the pivoting member is pivoted about the hinging mechanism enclosing the portion of the wire in the groove, wherein the cylindrical shell is movable along the longitudinal axis to toward the second end to extend the projection to secure the pivoting member in the closed position.

BRIEF DESCRIPTION OF THE DRAWINGS

The above and other aspects, features, and advantages of the present disclosure will become more apparent in light of the following detailed description when taken in conjunction with the accompanying drawings in which.

It should be understood that the drawings are for purposes of illustrating the concepts of the disclosure and are not necessarily the only possible configuration for illustrating the disclosure.

DETAILED DESCRIPTION

Preferred embodiments of the present disclosure will be described herein below with reference to the accompanying drawings. In the following description, well-known functions or constructions are not described in detail to avoid obscuring the present disclosure in unnecessary detail.

Figure 1A:
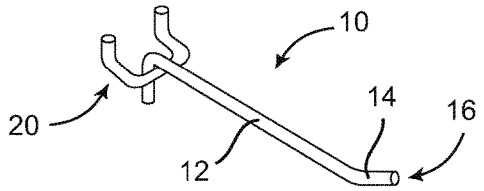
PRIOR ART FIG. 1A
FIG. 1A is a perspective view of a conventional peg hook for displaying products.
Figure 1B:
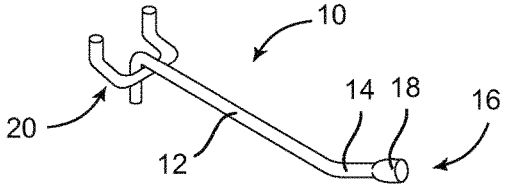
PRIOR ART FIG. 1B
FIG. 1B is a perspective view of a conventional peg hook with a ball tip for displaying products.
Figure 1C:
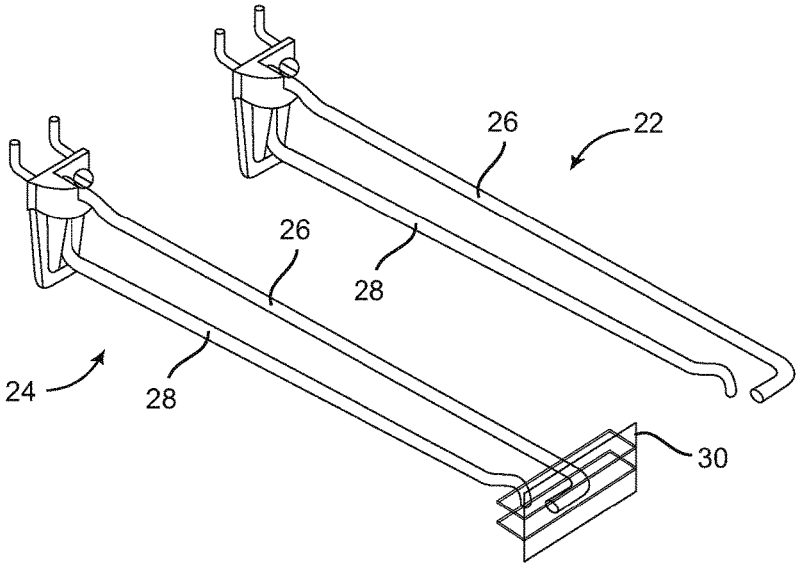
PRIOR ART FIG. 1C
FIG. 1C is a perspective view of conventional peg hooks with an information tag for displaying products.
Figure 1D:
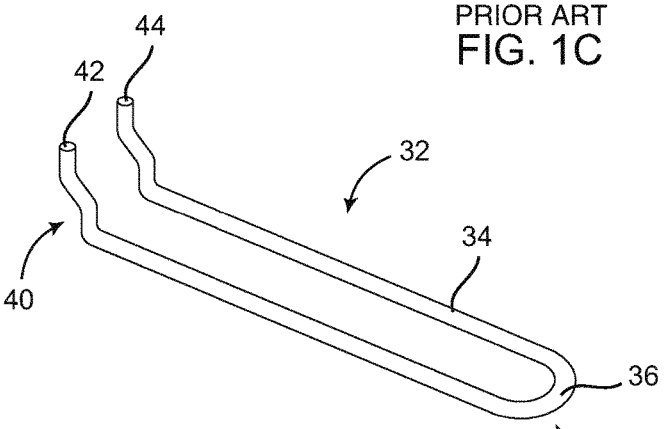
PRIOR ART FIG. 1D
FIG. 1D is a perspective view of a conventional double wire peg hook for displaying products.
Figure 2A:
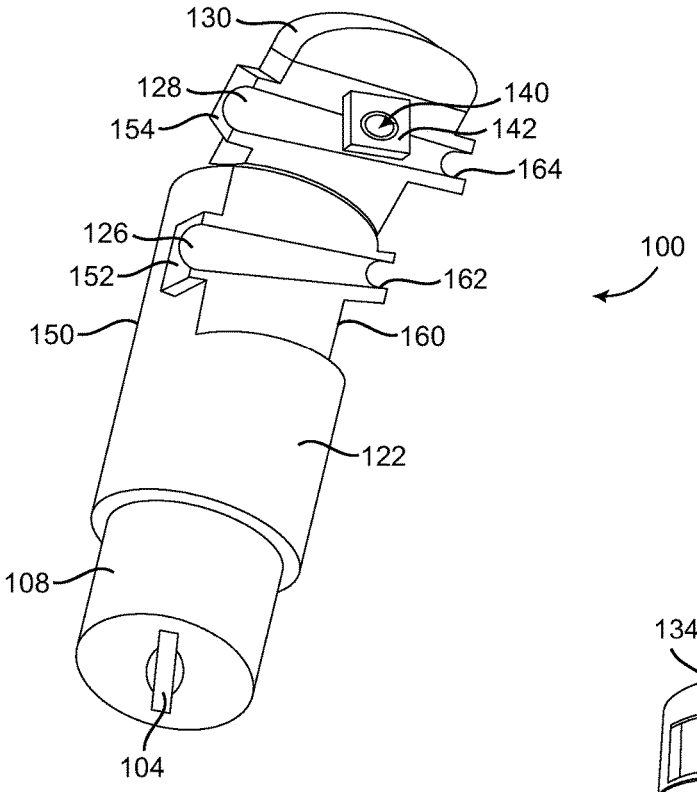
FIG. 2A is a perspective view of a locking device for securing a single wire peg hook in accordance with an embodiment of the present disclosure.
Figure 2B:
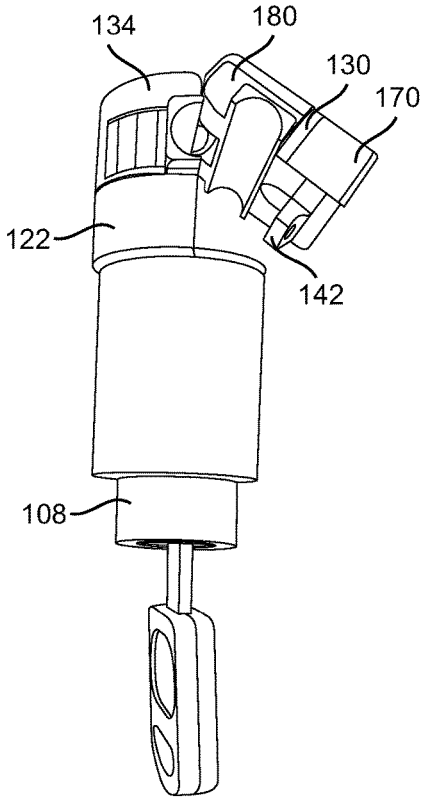
FIG. 2B illustrates the locking device of FIG. 2A in accordance with an embodiment of the present disclosure.
Figure 3A:
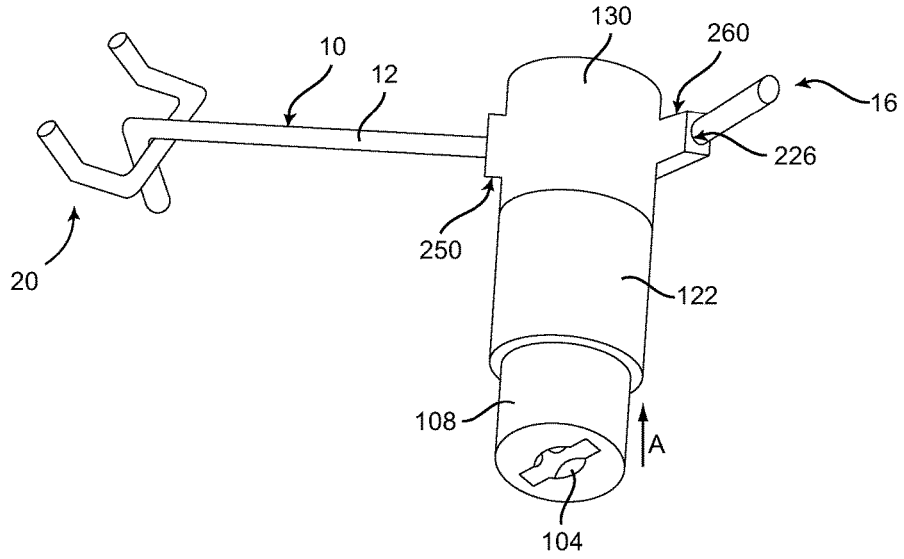
FIG. 3A illustrates the locking device of FIG. 2A coupled to a peg hook in accordance with an embodiment of the present disclosure.
Figure 3B:
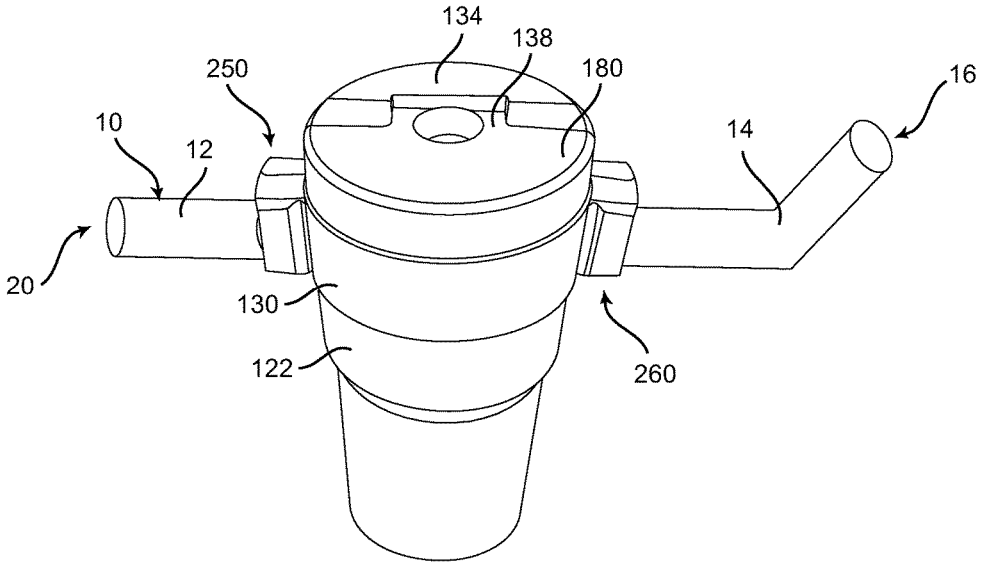
FIG. 3B is another illustration of the locking device of FIG. 2A coupled to a peg hook in accordance with an embodiment of the present disclosure.
Figure 4:
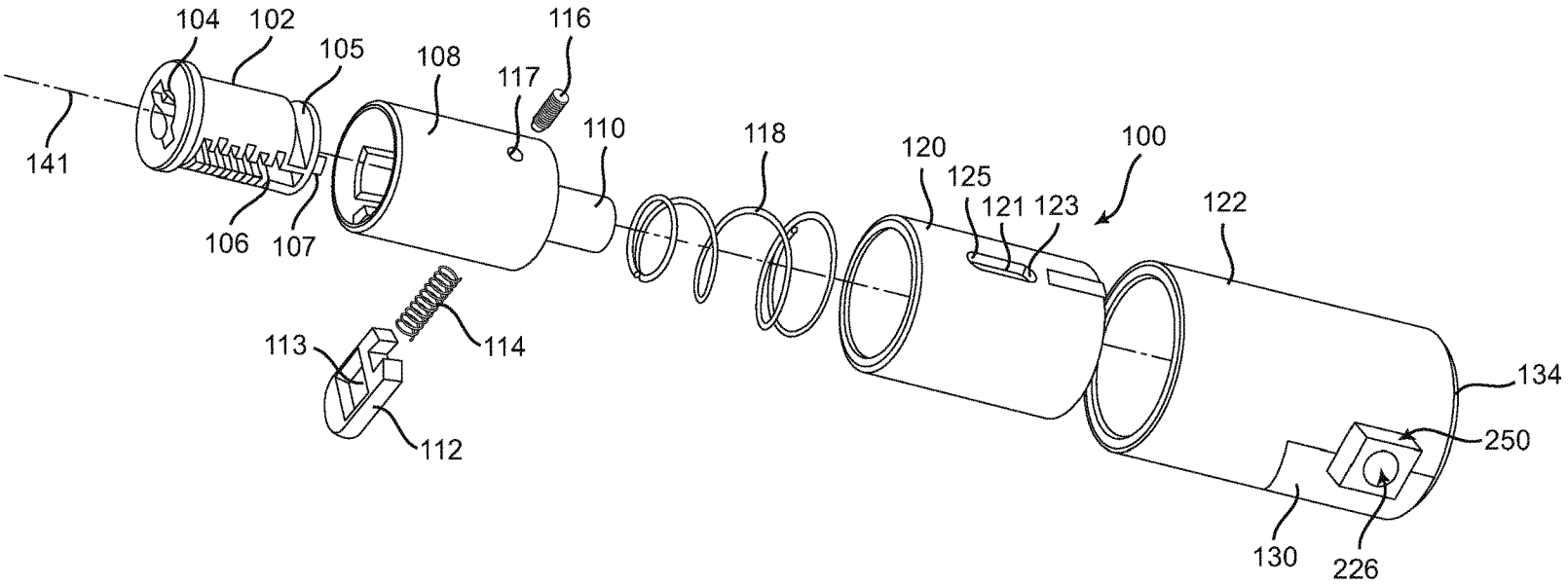
FIG. 4 is an exploded top perspective view of the locking device of FIG. 2A in accordance with an embodiment of the present disclosure.
Figure 5:
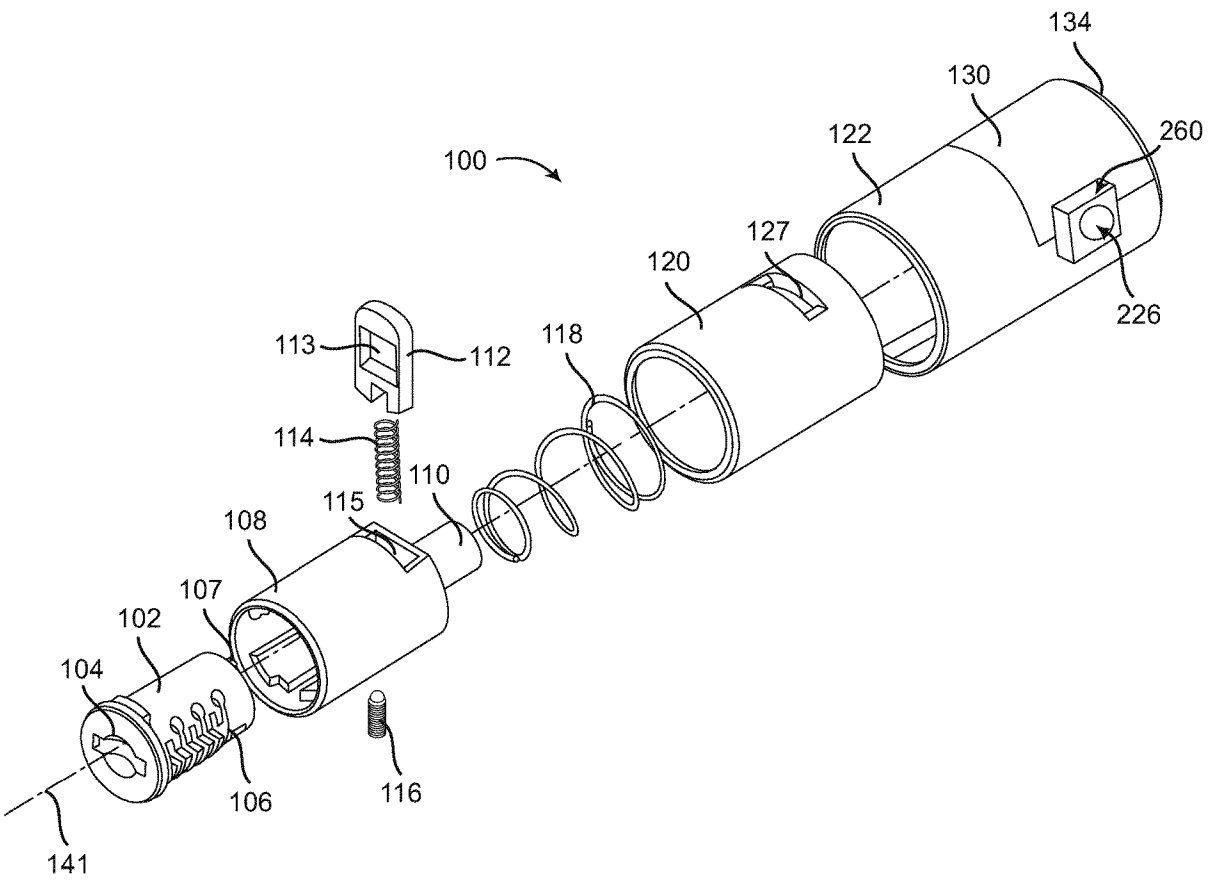
FIG. 5 is an exploded bottom perspective view of the locking device of FIG. 2A in accordance with an embodiment of the present disclosure.
Figure 6A:
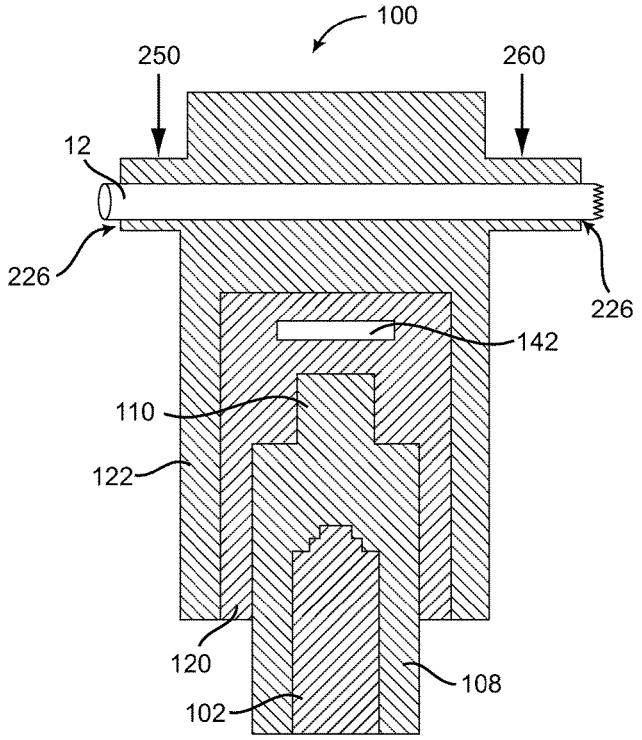
FIG. 6A is a cross-sectional view of the locking device of FIG. 2A in an unlocked position in accordance with an embodiment of the present disclosure.
Figure 6B:
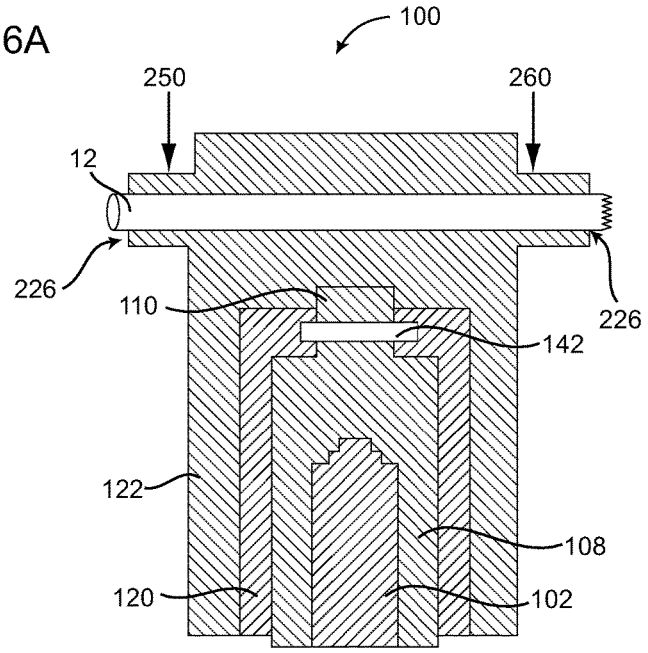
FIG. 6B is a cross-sectional view of the locking device of FIG. 2A in a locked position in accordance with an embodiment of the present disclosure.

Referring to FIGS. 2-6, a locking device 100 for a single wire peg hook is illustrated, where FIG. 2A is a perspective view of the locking device 100, FIG. 2B is another illustration of locking device 100, FIG. 3A is a view with the locking device 100 coupled to peg hook 10, FIG. 3B is another illustration of locking device 100 coupled to peg hook 10, FIG. 4 is an exploded top view of the locking device 100, FIG. 5 is an exploded bottom view of the locking device 100, FIG. 6A is a cross-sectional view of locking device 100 in an unlocked position, and FIG. 6B is a cross-sectional view of locking device 100 in a locked position.

The locking device 100 includes a cylinder plug 102, which includes a key hole 104, an arced channel 105 on an end opposite the key hole 104, and a plurality of tumblers 106. It is to be appreciated that the cylinder plug 102 may take forms other than that shown in figures, for example, the cylinder plug 102 may be an electronic cylinder core, a small format interchangeable core (SFIC), etc. The cylinder plug 102 is disposed in a cylindrical shell 108 and retained therein by barrel pin 116. A longitudinal axis 141 of the cylinder plug 102 may be aligned with a longitudinal axis of the cylindrical shell 108. Barrel pin 116 is disposed in an aperture 117 through a wall of the cylindrical shell 108 in such a manner that the barrel pin 116 projects from both sides of the wall of the cylindrical shell 108. On the inner portion of the wall of the cylindrical shell 108, the barrel pin 116 extends into arced channel 105 of the cylinder plug 102 to rotatably retain the cylinder plug 102 in the cylindrical shell 108.

A plunger locking bolt 112 and bolt spring 114 are disposed in slot 115 of cylindrical shell 108. Bolt spring 114 biases the plunger locking bolt 112 outwardly. Depending on a key position in the key hole 104 of the locking device 100, the plunger locking bolt 112 may be positioned in a "locked" or "unlocked" position. The cylindrical shell 108 includes a cylindrical projection or plunger 110, the function of which will be described below.

The cylindrical shell 108 is longitudinally aligned with and disposed in an inner body 120. The cylindrical shell 108 is biased away from the inner body 120 by a barrel spring 118. The portion of the barrel pin 116 extending outside the wall of the cylindrical shell 108 rides in an elongated slot 121 in a wall of the inner body 120. The slot 121 controls the longitudinal front to back motion of the cylindrical shell 108 with respect to the inner body 120. When the locking device 100 is locked, the barrel pin 116 will be at the back 123 of the slot 121. When unlocked, the barrel pin 116 will be at the front 125 of the slot 121.

The inner body 120 is further disposed in an outer housing 122 and is retained therein by retaining pins (not shown). Referring to FIGS. 2A and 2B, outer housing 122 includes peg groove 126, where peg groove 126 extends from one side 150 of outer housing 122 to opposite side 160 of outer housing 122. On side 150 of outer housing 122, peg groove 126 extends beyond the surface of outer housing 122 to form semi-cylindrical extension member 152. Similarly, on opposite side 160 of outer housing 122, peg groove 126 extends beyond the surface of outer housing 122 to form semi-cylindrical extension member 162. Peg groove 126 is generally positioned near an end 134 of the outer housing 122.

A pivoting member 130 is coupled to a first end 134 of the outer housing 122, the pivoting member including a first end 180 and a second end 170. The first end 180 of pivoting member 130 is coupled via hinge 138 (shown in FIG. 3B) to end 134 of the outer housing 122. Pivoting member 130 may be pivoted about hinge 138 to achieve an open position in relation to outer housing 122, as shown in FIG. 2A and FIG. 2B, or pivoting member 130 may be pivoted about hinge 138 to achieve a closed position in relation to outer housing 122, as shown in FIGS. 3-5.

Pivoting member 130 includes lug 142, which extends out perpendicularly from the flat inner surface of lower end 170 of pivoting member 130. Lug 142 includes aperture 140. Additionally, pivoting member 130 includes peg groove 128. Peg groove 128 extends from one side of pivoting member 130 to the opposite side of pivoting member 130. Similar to peg groove 126, peg groove 128 extends beyond the surface of either side of pivoting member 130 to form semi-cylindrical extension member 154 on one side of pivoting member 130 and semi-cylindrical extension member 164 on the other side of pivoting member 130.

When pivoting member 130 is pivoted such that it achieves a closed position in relation to outer housing 122, semi-cylindrical extension member 152 comes into contact with semi-cylindrical extension member 154 to form extension member 250 on side 150 of outer housing 122 and semi-cylindrical extension member 162 comes into contact with semi-cylindrical extension member 164 to form extension member 260 on side 160 of outer housing 122. Also, when pivoting member 130 is pivoted such that it achieves a closed position in relation to outer housing 122, as shown in FIGS. 3A and 3B, peg groove 126 and peg groove 128 come into contact and align to form channel 226, which extends from extension member 250 protruding on side 150 of outer housing 122 and pivoting member 130 to extension member 260 protruding on the opposite side 160 of outer housing 122 and pivoting member 130. It is to be appreciated that when pivoting member 130 is pivoted such that it achieves a closed position in relation to outer housing 122, aperture 140 on lug 142 is aligned along longitudinal axis 141.

In use, pivoting member 130 is pivoted such that pivoting member 130 is in an open position in relation to outer housing 122, as shown in FIG. 2A. While pivoting member 130 is in an open position, a portion of wire 12 (preferably, a portion close to bend 14) of peg hook 10 is placed in groove 126 on outer housing 122. Then, pivoting member 130 is pivoted such that pivoting member 130 achieves a closed position in relation to outer housing 122, as shown in FIG. 3A. When pivoting member 130 is in a closed position in relation to outer housing 122, the portion of wire 12 that was placed in groove 126 will now be secured in channel 226 with end 20 of wire 12 entering channel 226 in extension member 250 and end 16 of wire 12 exiting channel 226 in extension member 260, as shown in FIGS. 3A and 3B and FIGS. 6A and 6B.

Next, while maintaining pivoting member 130 in a closed position in relation to outer housing 122, locking device 100 is actuated (i.e., locked) by pressing the cylindrical shell 108 into the outer housing 122 in the direction of arrow A as shown in FIG. 3A. When cylindrical shell 108 is pressed in the direction of arrow A, projection 110 also moves in the direction of arrow A and passes through aperture 140 on pivoting member 130. FIG. 6A illustrates locking device 100 before cylindrical shell 108 has been actuated (i.e., in the unlocked position) and FIG. 6B illustrates locking device 100 after cylindrical shell 108 has been actuated (i.e., in the locked position) and projection 110 has passed through aperture 140 of lug 142. Inside locking device 100, after cylindrical shell 108 has been pressed, bolt spring 114 biases plunger locking bolt 112 into slot 127 of the inner body 120. Therefore, once projection 110 has passed through aperture 140, projection 110 is secured such that projection 110 cannot be moved in any direction. Thus, in the locked position shown in FIG. 6B, since projection 110 is positioned through aperture 140 of lug 142 such that projection 110 is holding the lug 142 in a fixed position and the lug 142 is fixed to pivoting member 130, pivoting member 130 is held in a closed position in relation to outer housing 122 and cannot be pivoted while in this position. In this manner, the locking device 100 is securely locked onto the peg hook 10 preventing removal of any items disposed thereon.

It is to be appreciated that in the locked position, extension members 250 and 260 provide additional security from the removal of any item disposed on peg hook 10. Because extension members 250 and 260 extend beyond the combined surface of outer housing 122 and pivoting member 130, extension members 250 and 260 extend the length of channel 226. By extending the length of channel 226, extension members 250 and 260 make it more difficult to attempt to remove the locking device 100 from peg hook 10 by pulling and twisting wire 12 in an attempt pass bend 14 in wire 12 through channel 226. Also, because extension members 250 and 260 extend the length of channel 226, if desired, a less pronounced bend may be used in wire 12 than would be possible in the absence of extension members 250 and 260 without compromising the security of locking device 100. Furthermore, because extension members 250 and 260 extend the length of channel 226, if desired, a peg hook 10 with a thinner wire 12 may be used without compromising the security of locking device 100.

To unlock and remove the locking device 100, a correct key is inserted into the key hole 104 releasing cylindrical shell 108, which is forced away from the outer housing 122 via the barrel spring 118. When the correct key is inserted into the key hole 104, the tumblers 106 are engaged to create a "shear line" to allow the cylindrical plug 102 to rotate clockwise. An engaging element 107 protruding from a rear portion of the cylindrical plug 102 engages an aperture 113 of the spring-loaded plunger locking bolt 112 as the cylindrical plug 102 is rotated, pulling the plunger locking bolt 112 inward. Upon being driven inward, the plunger locking bolt 112 disengages from the slot 127 of the inner body 120 and barrel spring 118 pushes the cylindrical shell 108 out, thereby removing projection 110 from aperture 140 of lug 142 on pivoting member 130. When projection 110 is drawn back and removed from aperture 140, pivoting member 130 may once again achieve an open position in relation to outer housing 122 to allow the portion of wire 12 that was previously disposed in channel 226 to be released, therefore allowing the lock to be removed to access the desired merchandise. In some embodiments, the locking device 100 may be used with any wire 12, peg hook, strike plate, and any device with an extending wire arm, with or without a bend in the wire. The locking device 100 may be configured to clamp the side of the wire, either at a straight section or bent section of the wire.

It is to be appreciated that although locking device 100 is designed in a generally cylindrical shape, it is contemplated to be within the scope of the present disclosure for locking device 100 to be shaped in other ways as well to provide different advantages in safety and/or to satisfy differing user preferences. For instance, in FIGS. 7-9, an alternative embodiment, locking device 300, is shown in accordance with the present disclosure, where locking device 300 is shaped in a generally rectangular configuration. Although the internal components of locking device 300 are not shown in FIGS. 7-9, it is to be appreciated that the internal components in locking device 300 are similar to the internal components of locking device 100 described above and shown in FIGS. 4-5.

Turning to FIGS. 7A-F, locking device 300 is shown in a closed position (as will be described below) from various viewpoints in accordance with the present disclosure. As shown in FIGS. 7A-F, locking device 300 includes an outer housing 322 with a first end 334 and a second end 333, where first end 334 is opposite to second end 333. Furthermore, outer housing 322 includes sides 350, 355, 360, and 365, where side 350 is opposite to side 360, side 355 is opposite to side 365, and sides 355 and 365 are each adjacent to sides 350 and 360.

As seen in FIGS. 7A-F, cylindrical shell 308 is disposed in outer housing 322. It is to be appreciated that cylindrical shell 308 may be further disposed in an inner housing (not shown) as described in the above embodiment. Cylindrical shell 308 includes a key hole (not shown) disposed centrally on a circular end 309 of cylindrical shell 308, where a key 305 may be inserted into the key hole.

Figure 8A:
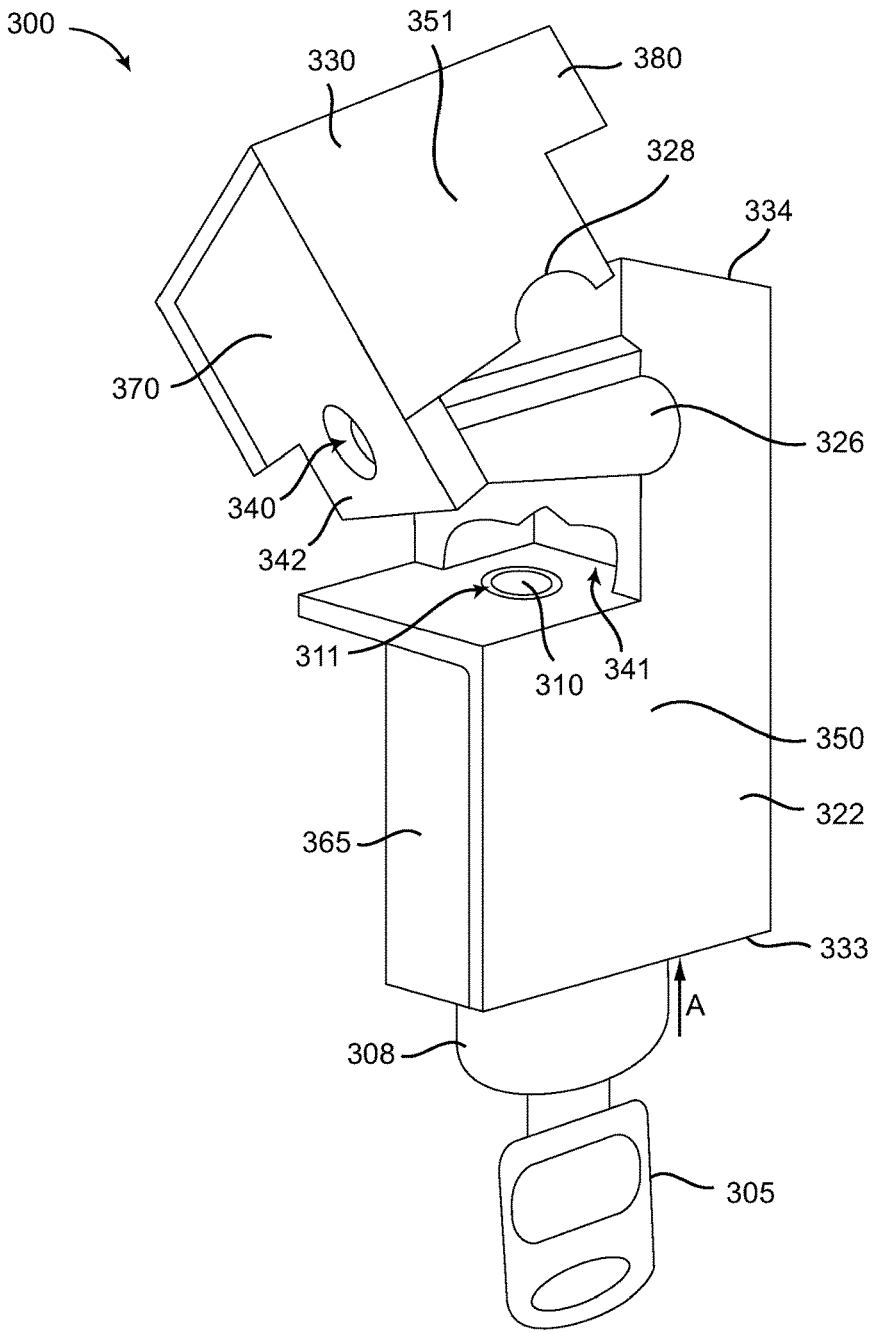
FIG. 8A is a perspective view of the locking device of FIG. 7A in an open position in accordance with an embodiment of the present disclosure.

Turning to FIG. 8A, a perspective view of locking device 300 in an open position is shown in accordance with the present disclosure. As seen in FIG. 8A, outer housing 322 also includes peg groove 326. Peg groove 326 is shaped semi-cylindrically and extends from one side 350 of outer housing 322 to the opposite side 360 of outer housing 322. Peg groove 326 is generally positioned near an end 334 of outer housing 322.

Figure 8B:
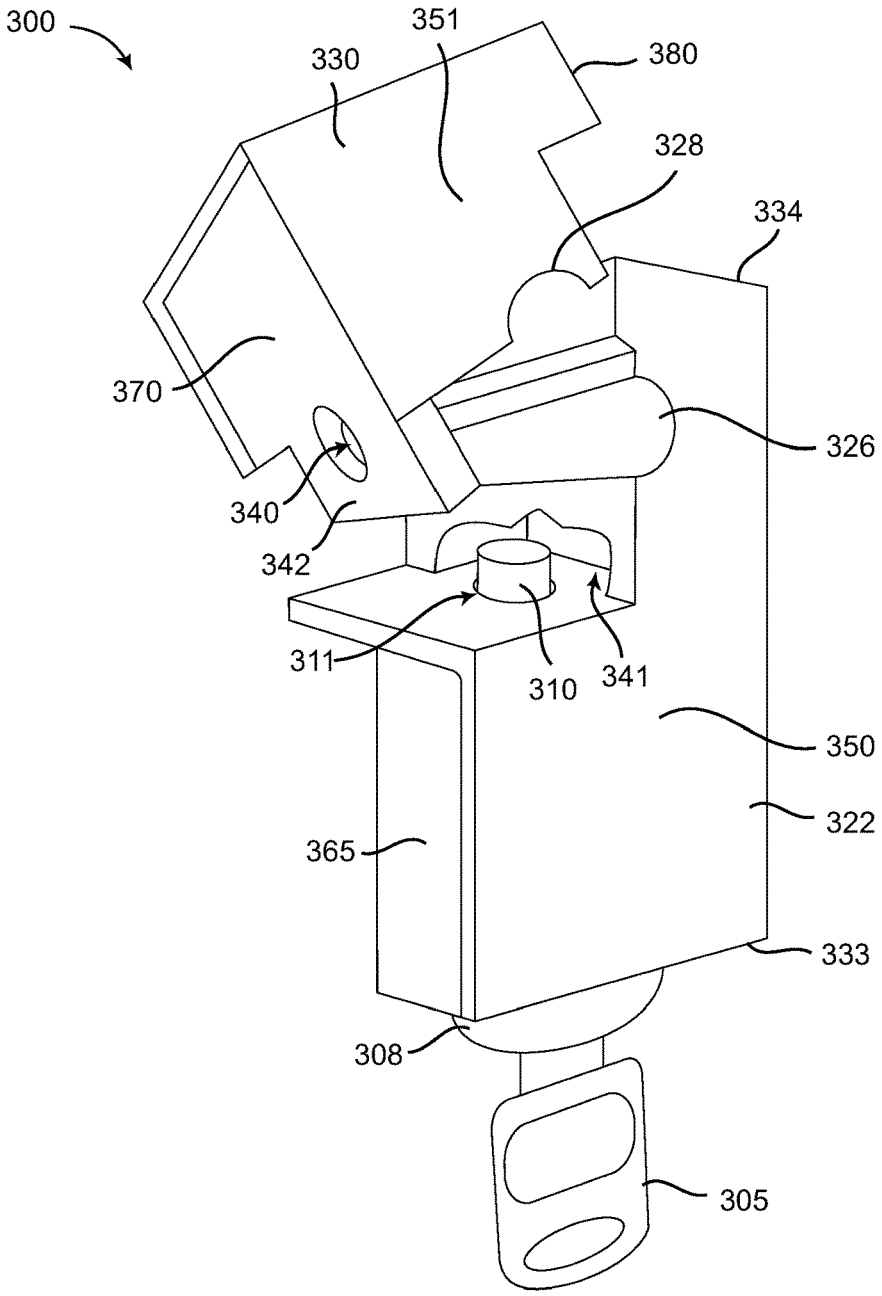
FIG. 8B is a perspective view of the locking device of FIG. 7A in an open and unlocked position in accordance with an embodiment of the present disclosure.

Below peg groove 326 in FIG. 8A, outer housing 322 includes slot 341, where slot 341 is configured to receive a lug as will be described below. The slot 341 at least partially encloses an aperture 311, which allows cylindrical projection 310 to enter the area formed by the slot 341. When cylindrical shell 308 is pressed in the direction of arrow A, projection 310 will also move in the direction of arrow A. FIG. 8B illustrates the locking device 300 after cylindrical shell 308 has been pressed in direction A causing projection 310 to also move in direction A.

Figure 7A:
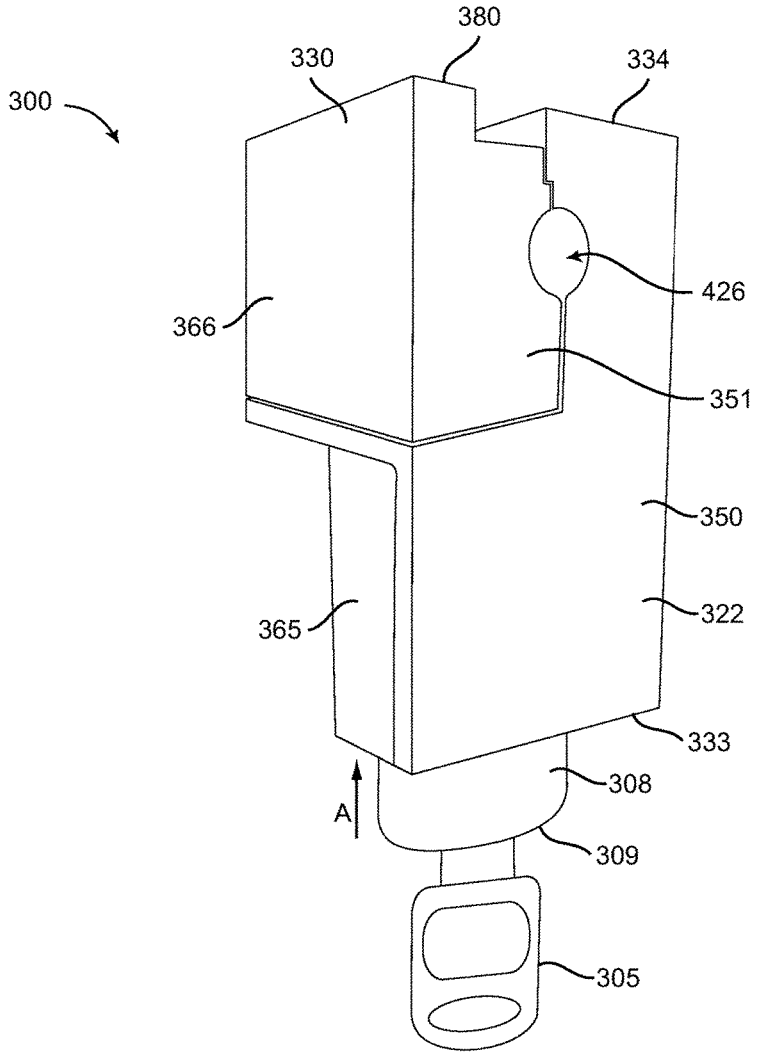
FIG. 7A is a perspective view a locking device in a closed position in accordance with an alternative embodiment of the present disclosure.
Figure 7B:
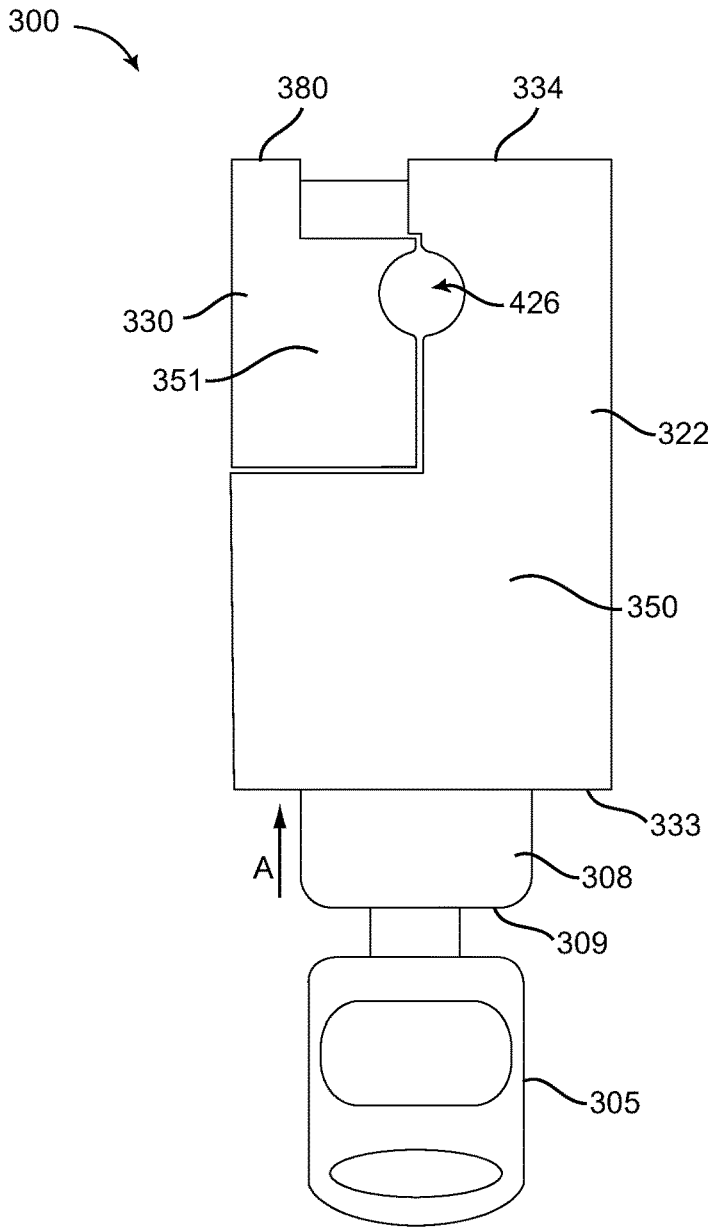
FIG. 7B is a front view of the locking device of FIG. 7A in a closed position in accordance with an embodiment of the present disclosure.
Figure 7C:
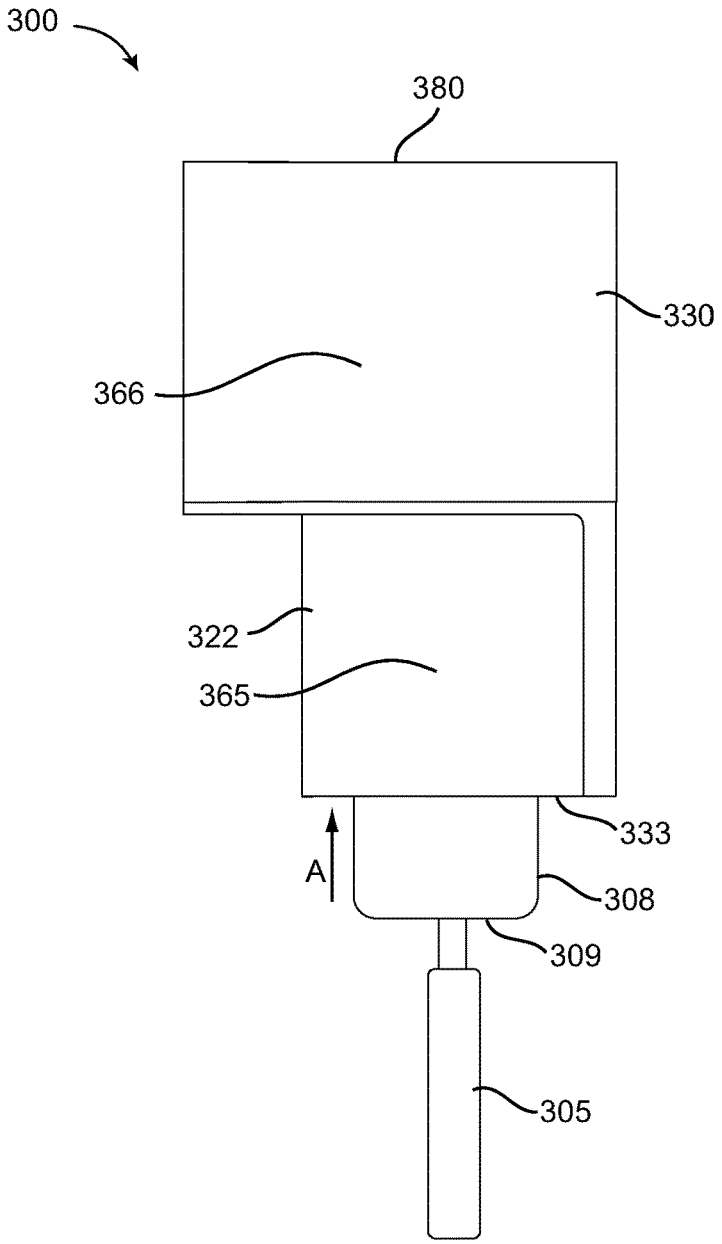
FIG. 7C is a side view of the locking device of FIG. 7A in a closed position in accordance with an embodiment of the present disclosure.
Figure 7D:
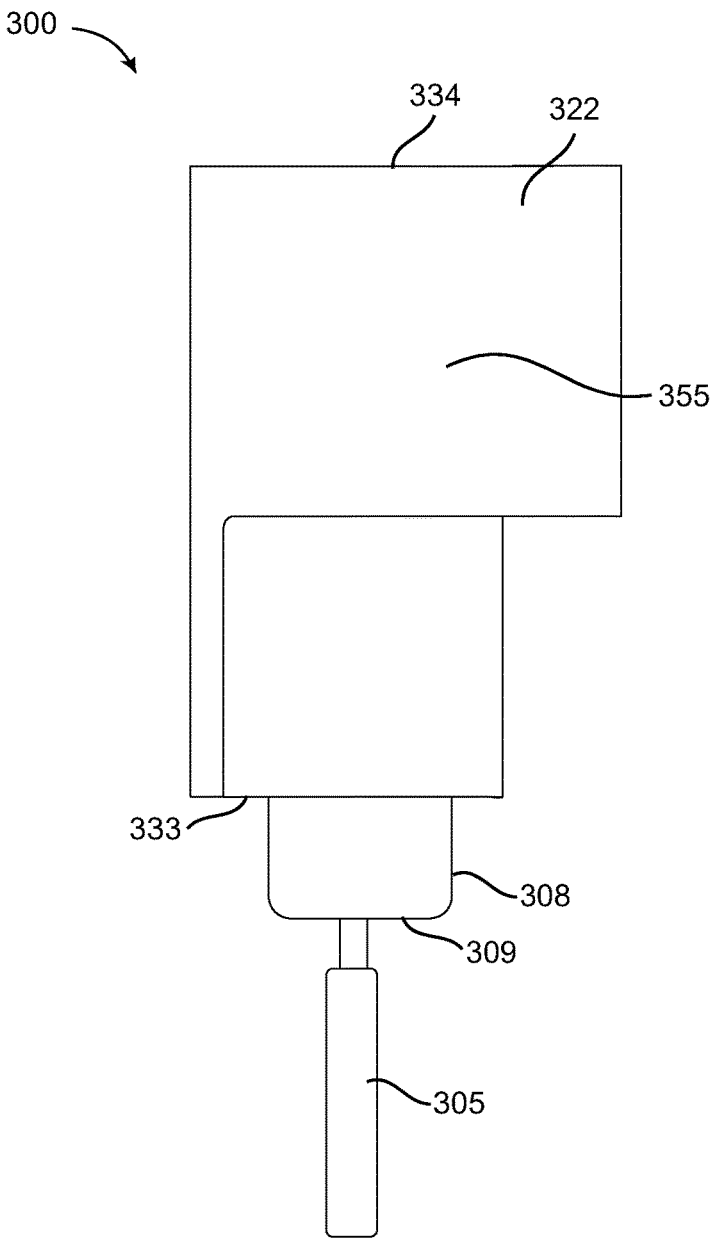
FIG. 7D is a side view, opposite to the side view of FIG. 7C, of the locking device of FIG. 7A in a closed position in accordance with an embodiment of the present disclosure.
Figure 7E:
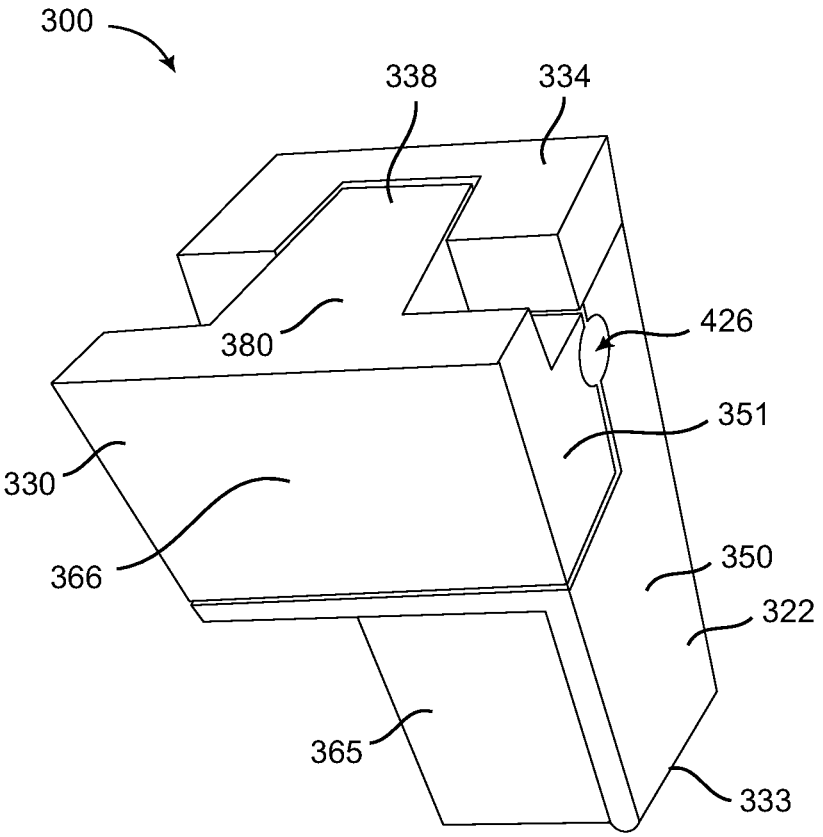
FIG. 7E is a top-side perspective view of the locking device of FIG. 7A in a closed position in accordance with an embodiment of the present disclosure.
Figure 7F:
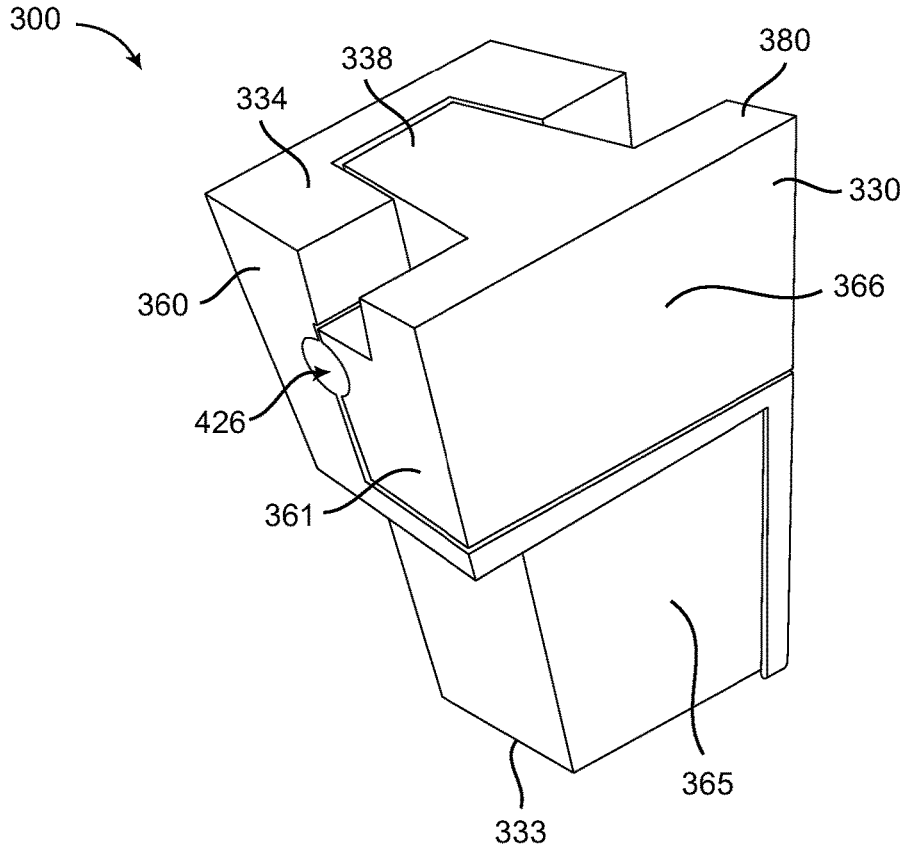
FIG. 7F is an alternative top-side view of the locking device of FIG. 7A in a closed position in accordance with an embodiment of the present disclosure.

Referring again to FIGS. 7A-F, locking device 300 also includes pivoting member 330. Pivoting member 330 includes a first end 380 and a second end 370 (second end 370 is shown in FIG. 8A), where first end 380 of pivoting member 330 is coupled to first end 334 of outer housing 322 via hinge 338 (as seen in FIGS. 7E and F). Pivoting member 330 also includes sides 351, 361 and 366, where side 351 is opposite to side 361 and side 366 is adjacent to sides 351 and 361. It is to be appreciated that in FIG. 7A-F, side 351 of pivoting member 330 faces the same direction as side 350 of outer housing 322, side 366 of pivoting member 330 faces the same direction as side 365 of outer housing 322, side 361 of pivoting member 330 faces the same direction as side 360 of outer housing 322, and end 380 of pivoting member 330 face the same direction as end 334 of outer housing 322.

Turning again to FIG. 8A, as stated above, first end 380 of pivoting member 330 is coupled to first end 334 of outer housing 322 via hinge 338. Pivoting member 330 is coupled to outer housing 322 such that pivoting member 330 may be pivoted about hinge 338 to achieve an open position in relation to outer housing 322 (as shown in FIG. 8A), or pivoting member 330 may be pivoted about hinge 338 to achieve a closed position in relation to outer housing 322 (as shown in FIGS. 7A-7F).

Pivoting member 330 further includes lug 342, which extends out perpendicularly from the flat inner surface of lower end 370 of pivoting member 330. Lug 342 includes aperture 340. Additionally, pivoting member 330 includes peg groove 328. Peg groove 328 is shaped semi-cylindrically (like peg groove 326) and extends from one side 351 of pivoting member 330 to the opposite side 361 of pivoting member 330.

When pivoting member 330 is pivoted such that it achieves a closed position in relation to outer housing 322, as shown in FIGS. 7A-F, peg groove 326 and peg groove 328 come into contact and align to form channel 426, which extends from the combined surface of side 350 of outer housing 322 and side 351 of pivoting member 330 to the oppositely formed combined surface of side 360 outer housing 322 and side 361 of pivoting member 330. It is to be appreciated that when pivoting member 330 is pivoted such that it achieves a closed position in relation to outer housing 322, aperture 340 on lug 342 is aligned with projection 310 such that when projection 310 is extended by pressing cylindrical shell 308, projection 310 passes through aperture 340 of lug 342 on pivoting member 330.

Figure 9A:
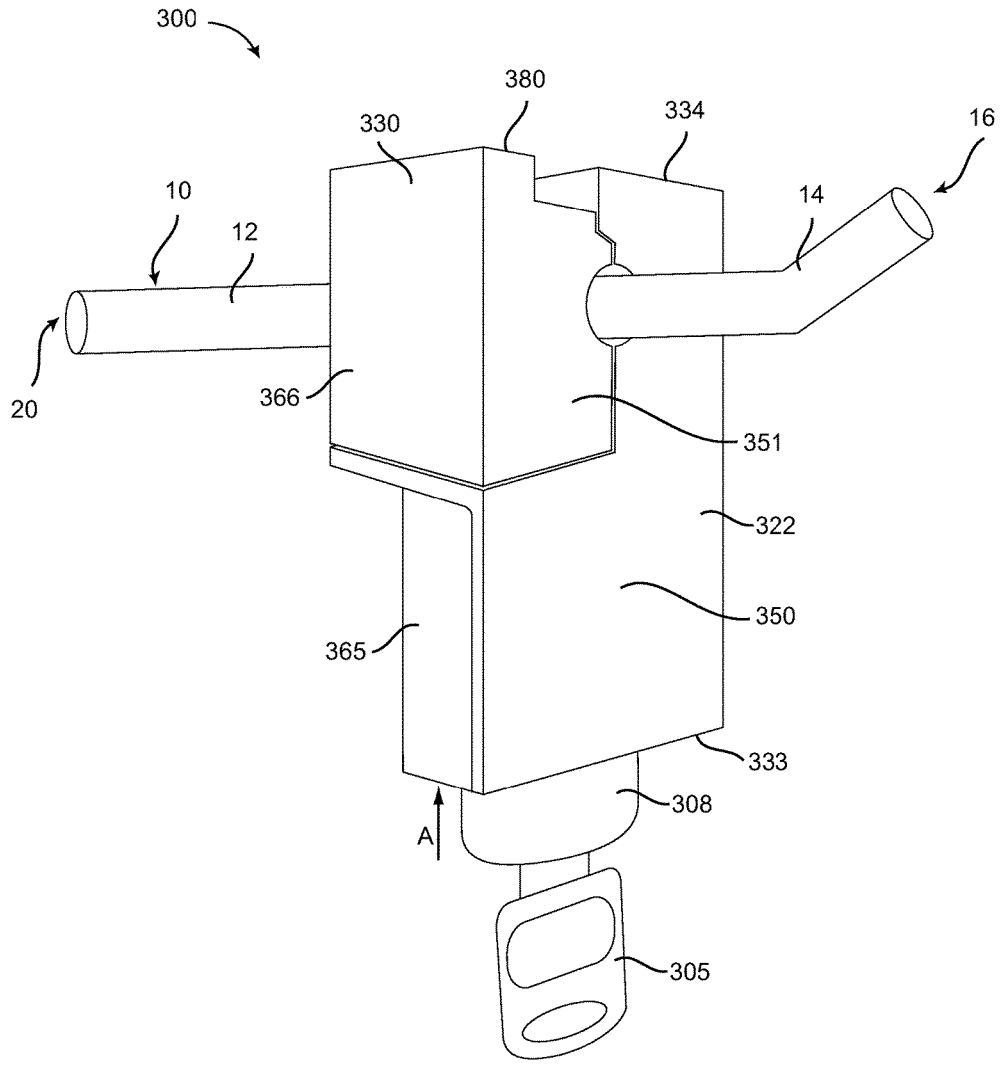
FIG. 9A is a perspective view of the locking device of FIG. 7A coupled to a peg hook in accordance with an embodiment of the present disclosure.
Figure 9B:
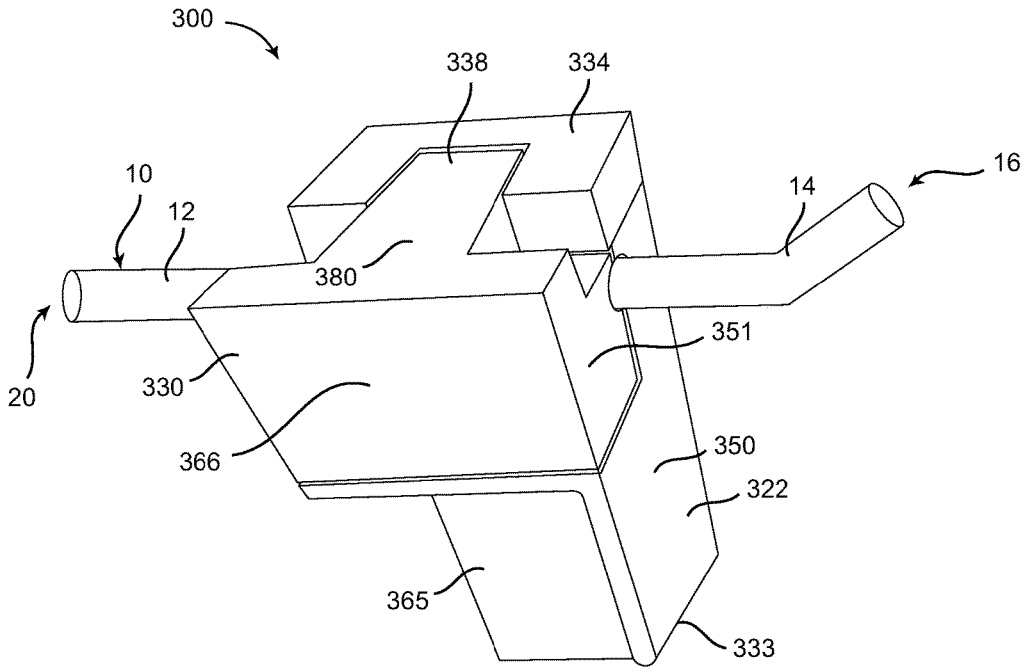
FIG. 9B is a top-side perspective view of the locking device of FIG. 7A coupled to a peg hook in accordance with an embodiment of the present disclosure.
Figure 9C:
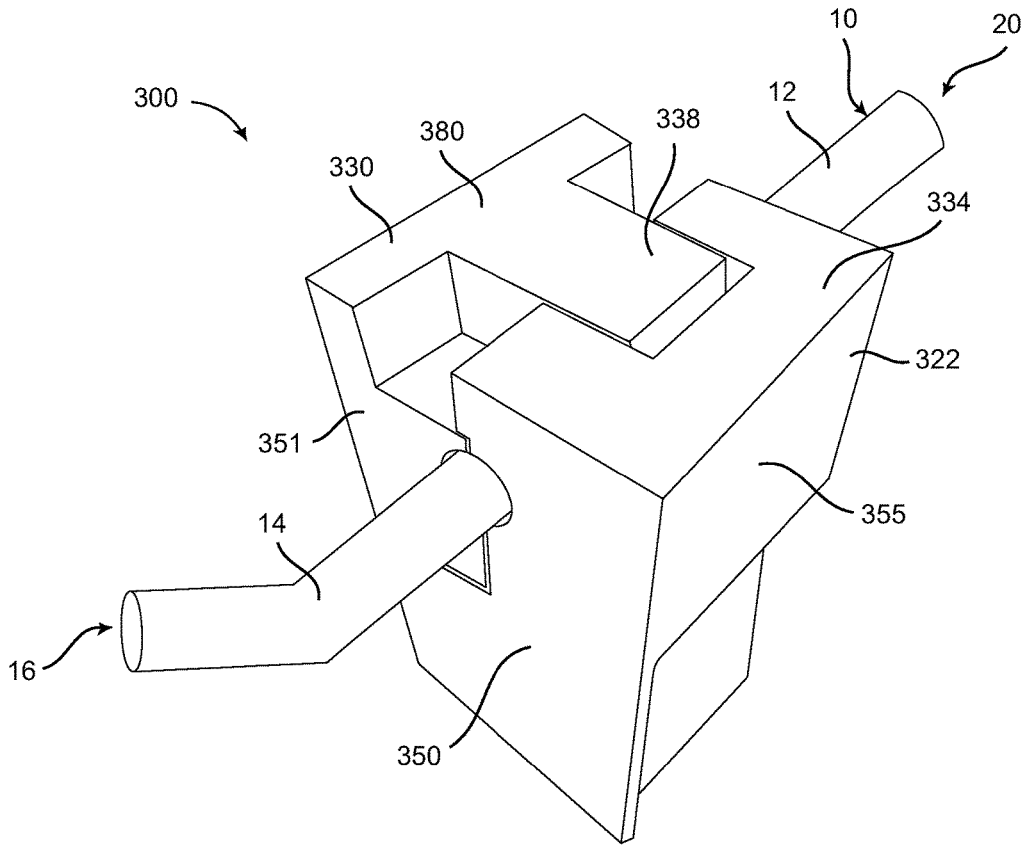
FIG. 9C is another top-side perspective view of the locking device of FIG. 7A coupled to a peg hook in accordance with an embodiment of the present disclosure.

In use, pivoting member 330 of locking device 300 is pivoted such that pivoting member 330 is in an open position in relation to outer housing 322, as shown in FIG. 8A. While pivoting member 330 is in an open position, a portion of wire 12 (preferably, a portion close to bend 14) of peg hook 10 is placed in peg groove 326 on outer housing 322. Then, pivoting member 330 is pivoted such that pivoting member 330 achieves a closed position in relation to outer housing 322, as shown in FIG. 9A-C. When pivoting member 330 is in a closed position in relation to outer housing 322, the portion of wire 12 that was placed in peg groove 326 will now be secured in channel 426 with end 20 of wire 12 entering channel 426 on side 361 of pivoting member 330 and 360 of outer housing 322, and end 16 of wire 12 exiting channel 426 on side 351 of pivoting member 330 and 350 of outer housing 351, as shown in FIGS. 9A-C.

Next, while maintaining pivoting member 330 in a closed position in relation to outer housing 322, locking device 300 is actuated (i.e., locked) by pressing the cylindrical shell 308 into the outer housing 322 in the direction of arrow A as shown in FIGS. 8A and 8B. When cylindrical shell 308 is pressed in the direction of arrow A, projection 310 also moves in the direction of arrow A and passes through aperture 340 of lug 342 on pivoting member 330. Once projection 310 has passed through aperture 340, projection 310 is secured such that projection 310 cannot be moved in any direction. Thus, since projection 310 is positioned through aperture 340 such that projection 310 is holding lug 342 in a fixed position and lug 342 is fixed to pivoting member 330, pivoting member 330 is held in a closed position in relation to outer housing 322 and cannot be pivoted while in this position. In this manner, the locking device 300 is securely locked onto the peg hook 10 preventing removal of any items disposed thereon.

To unlock and remove the locking device 300, a correct key 305 is inserted into the key hole (not shown) and key 305 is rotated clockwise, releasing cylindrical shell 108, which is forced away from the outer housing 322 via a barrel spring (not shown) inside locking device 300. When cylindrical shell 308 is forced away from outer housing 322, projection 310 is drawn back in the same direction as cylindrical shell 308 (the direction opposite to arrow A in FIG. 8A), thereby removing projection 310 from aperture 340 of lug 342 on pivoting member 330. When projection 310 is drawn back and removed from aperture 340, pivoting member 330 may once again achieve an open position in relation to outer housing 322 to allow the portion of wire 12 that was previously disposed in channel 426 to be released, therefore allowing the lock to be removed to access the desired merchandise.

It is to be appreciated that in an alternative embodiment first end 334 of outer housing 322 and side 355 of outer housing 322 in locking device 300 may be altered to form a single curved surface rather than two flat surfaces facing perpendicular to each other. Similarly, first end 380 of pivoting member 338 and side 366 of pivoting member 330 in locking device 300 maybe also be altered to form a single curved surface rather than two flat surface facing perpendicular to each other. An embodiment with the above described alterations to first end 334 and side 355 of outer housing 322 and first end 380 and side 366 of pivoting member 330 of locking device 300 will be will be described below in reference to FIGS. 10A and 10B. It is to be appreciated that, internally, the locking device described in FIGS. 10A and 10B contains the same components as locking device 300 and operates in the same manner as described above.

Figure 10A:
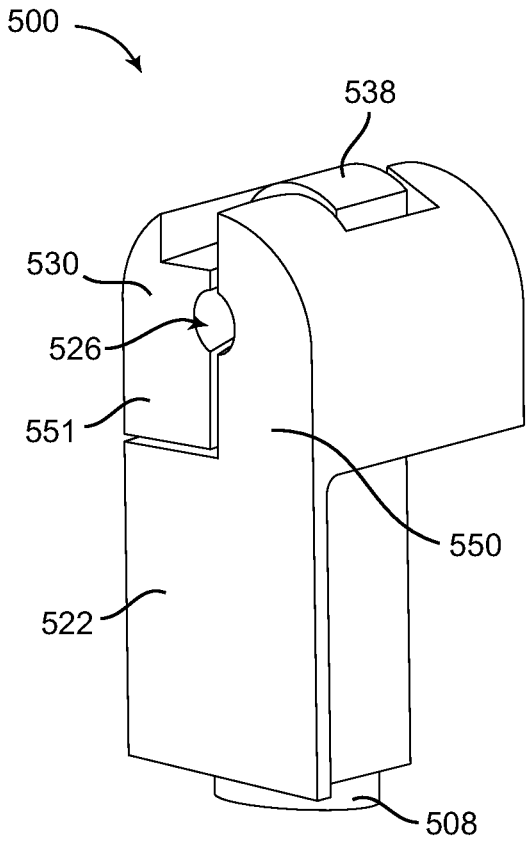
FIG. 10A is a perspective view a locking device in a closed position in accordance with yet another embodiment of the present disclosure.

Turning to FIG. 10A, a perspective view of locking device 500 is shown in accordance with an embodiment of the present disclosure. Locking device 500 includes outer housing 522, where outer housing 522 includes side 550. As in the above described embodiments, a cylindrical shell 508 is disposed in outer housing 522. It is to be appreciated that cylindrical shell 508 may be further disposed in an inner housing (not shown) as described in embodiments above. Although not shown, cylindrical shell 508 includes a key hole (not shown), where a key may be inserted into the key holes similar to cylindrical shell 308 of locking device 300.

Outer housing 522 is coupled to pivoting member 530 via hinge 538, where pivoting member 530 includes side 551. It is to be appreciated that side 551 of pivoting member 530 faces in the same direction as side 550 of outer housing 522. Also, it is to be appreciated that pivoting member 530 may be pivoted about hinge 538 to achieve open and closed positions (as described in previous embodiments), where FIG. 10A, shows locking device 500 in a closed position. When pivoting member 530 is pivoted such that pivoting member 530 achieves a closed position in relation to outer housing 522, channel 526 is formed. Channel 526 extends from the combined flat surface formed by side 551 of pivoting member 530 and side 550 of outer housing 522 to the opposite side of locking device 500 (not shown).

Figure 10B:
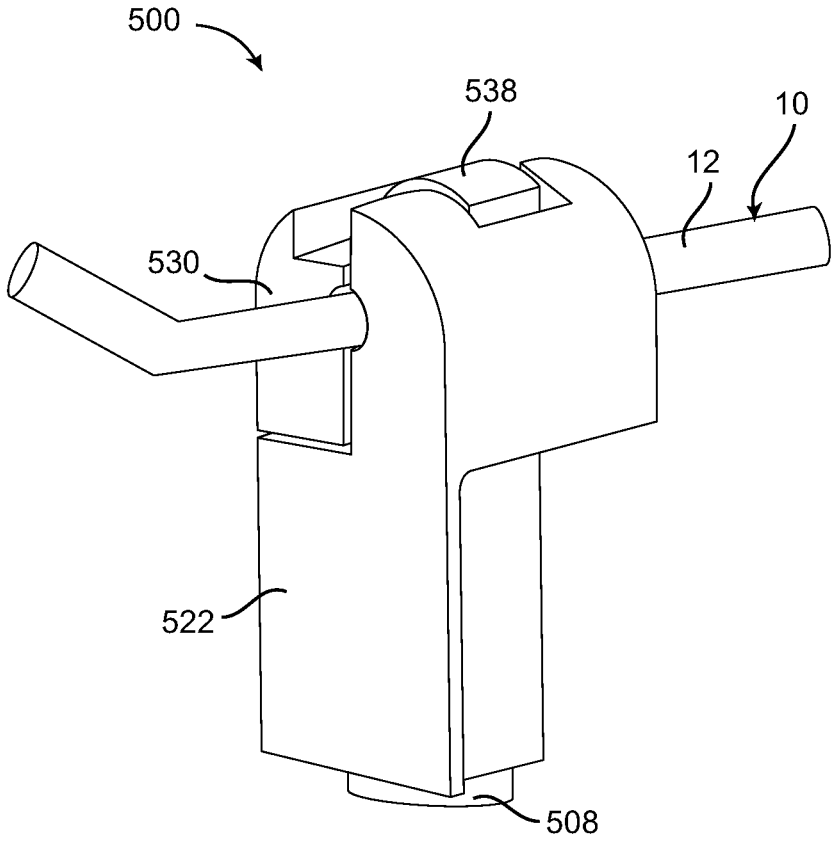
FIG. 10B is a perspective view of the locking device of FIG. 10A coupled to a peg hook in accordance with an embodiment of the present disclosure.

Turning to FIG. 10B, a perspective view of locking device 500 with a portion of wire 12 of peg hook 10 held securely in channel 526 is shown in accordance with an embodiment of the present disclosure. In use, locking device 500 may be used to prevent access to items disposed on peg hook 10 in an identical manner to locking device 300 as described above, therefore, the method for using locking device 500 will not be described again here.

Referring now to FIGS. 11A-D, yet another embodiment of a locking device in accordance with the present disclosure is shown. It is to be appreciated that the locking device shown in FIGS. 11A-D operates in a similar manner and contains the same internal components as locking device 300 described above.

Figure 11A:
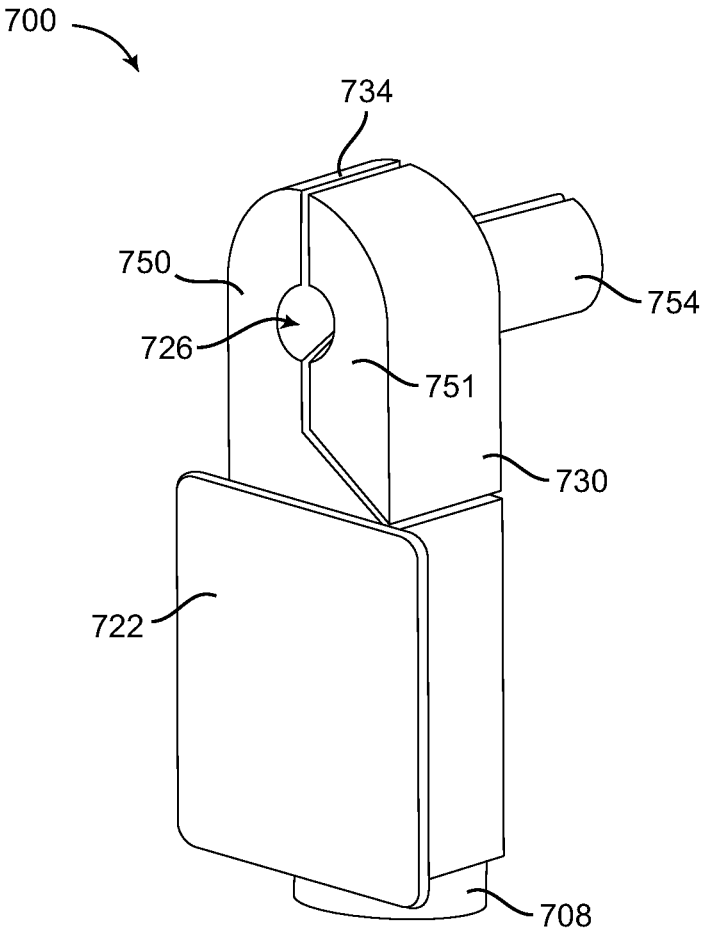
FIG. 11A is a perspective view of a locking device in a closed position in accordance with another embodiment of the present disclosure.
Figure 11B:
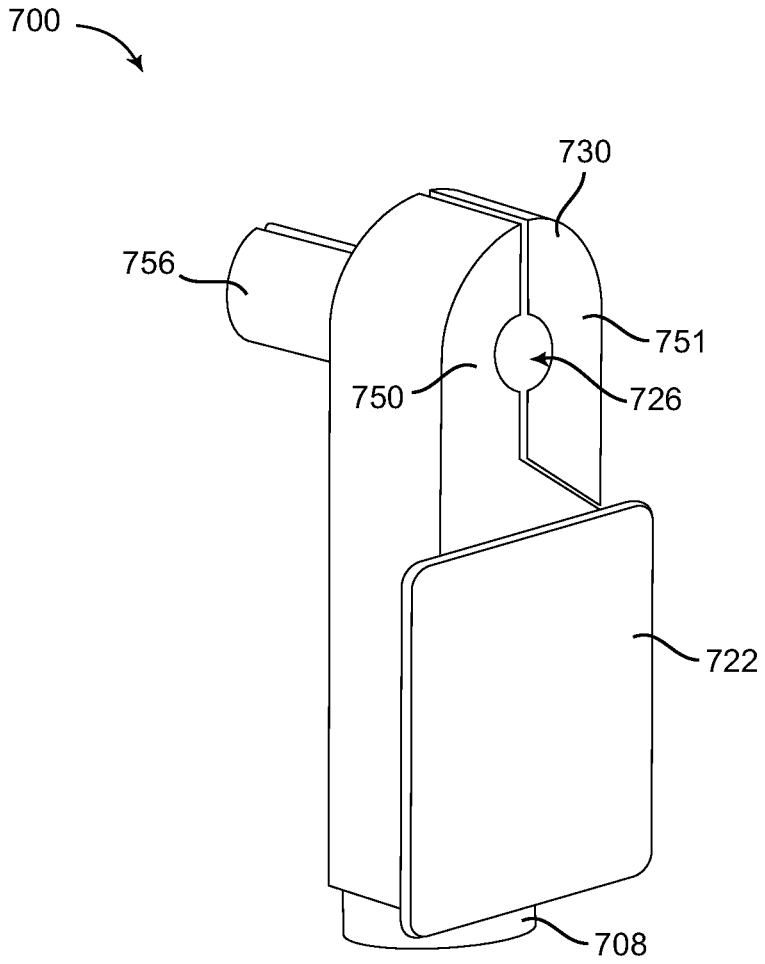
FIG. 11B is another perspective view of the locking device of FIG. 11A in accordance with an embodiment of the present disclosure.
Figure 11C:
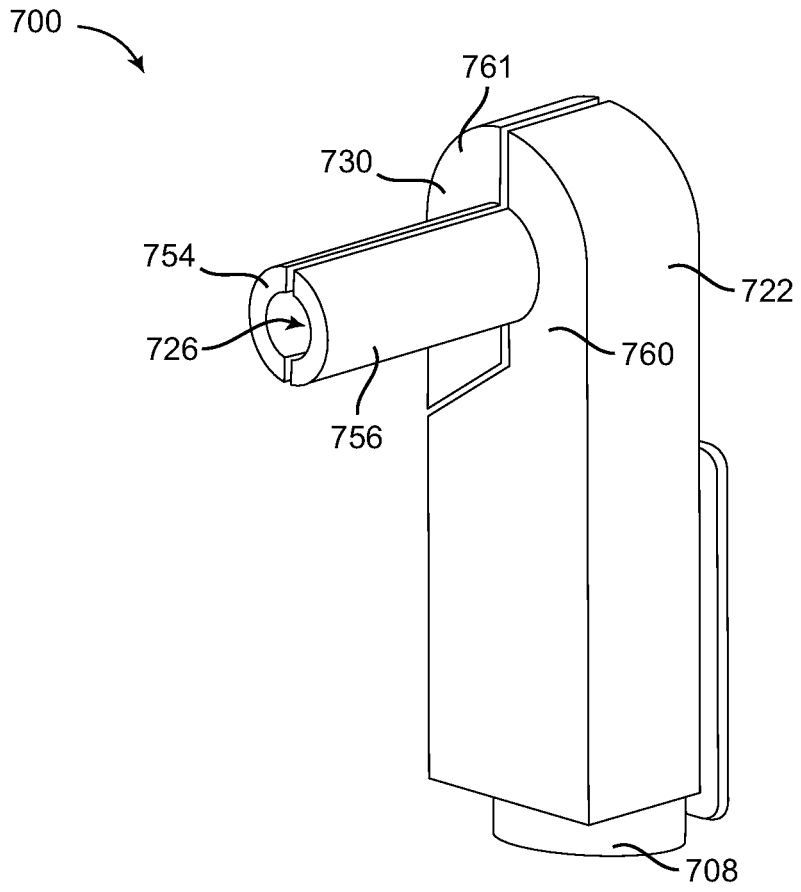
FIG. 11C is yet another perspective view of the locking device of FIG. 11A in accordance with an embodiment of the present disclosure.

Referring to FIGS. 11A-C, various perspective views of a locking device 700 are shown. As seen in FIGS. 11A-C, locking device 700 includes outer housing 722, where outer housing 722 includes side 750 and opposite side 760. Outer housing 722 also includes semi-cylindrical extension member 756. As in previous embodiments, a cylindrical shell 708 is disposed in outer housing 722. It is to be appreciated that cylindrical shell 708 may be further disposed in an inner housing (not shown) as described in embodiments above. Although not shown, cylindrical shell 508 includes a key hole (not shown), where a key may be inserted into the key holes similar to cylindrical shell 308 of locking device 300.

Outer housing 722 is coupled to pivoting member 730 via a hinge (not shown) located near an end 734 of locking device 700. It is to be appreciated that pivoting member 730 may be pivoted about a hinge to achieve open and closed positions (as described in previous embodiments), where FIG. 11A-C show locking device 700 in a closed position. Pivoting member 730 includes a side 751 and opposite side 761, where side 751 of pivoting member 730 faces in the same direction as side 750 of outer housing 722 and opposite side 761 of pivoting member 730 faces in the same direction of side 760 of outer housing 722. Pivoting member 730 also includes semi-cylindrical extension member 754.

When pivoting member 730 is pivoted such that pivoting member 730 achieves a closed position in relation to outer housing 722, semi cylindrical extension members 754 and 756 come into contact to form a channel 726. Channel 726 extends from the combined flat surface formed by side 751 of pivoting member 730 and side 750 of outer housing 722 to the combined flat surface formed by opposite side 751 of outer housing 722 and opposite side 761 of pivoting member 730.

Figure 11D:
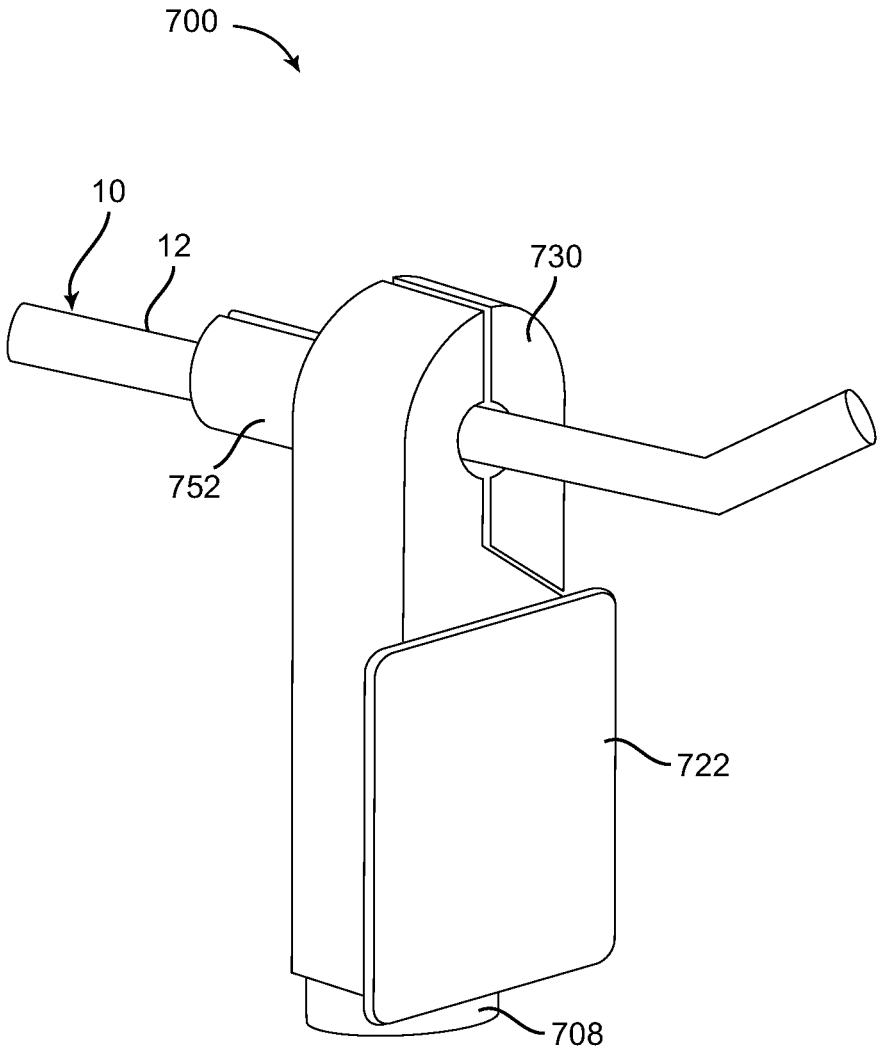
FIG. 11D is a perspective view of the locking device of FIG. 11A coupled to a peg hook in accordance with an embodiment of the present disclosure.
Figure 12A:
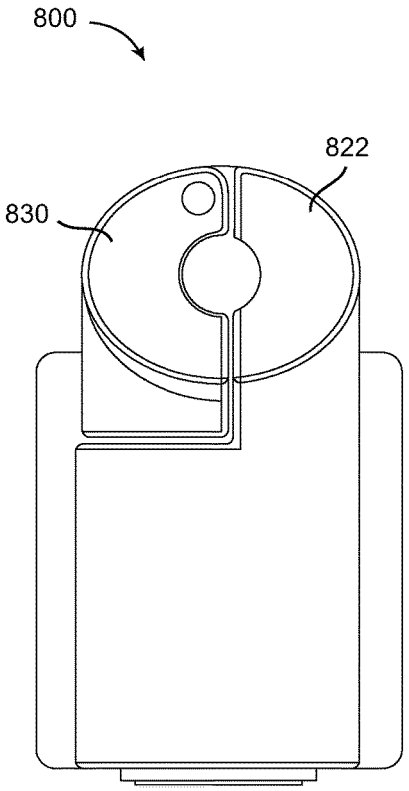
FIG. 12A is a front view of a locking device in accordance with another embodiment of the present disclosure.
Figure 12B:
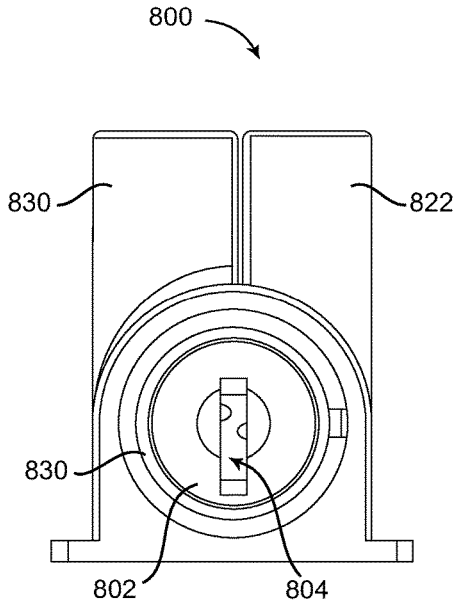
FIG. 12B is a bottom view of the locking device of FIG. 12A in accordance with an embodiment of the present disclosure.
Figure 12C:
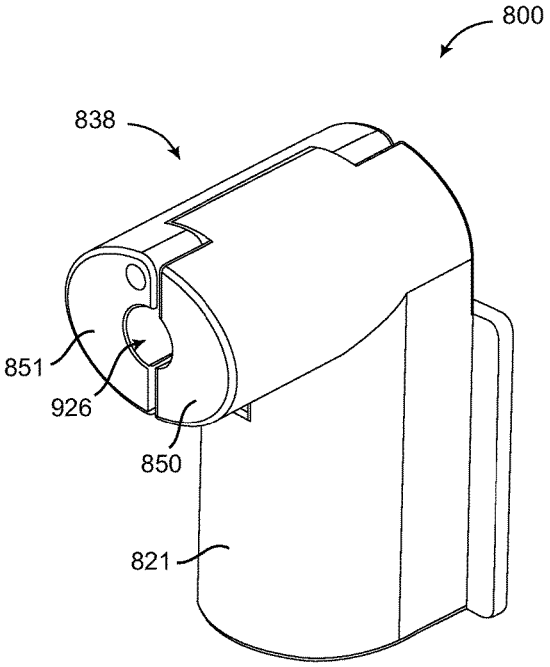
FIG. 12C is perspective view of the locking device of FIG. 12A in accordance with an embodiment of the present disclosure.
Figure 12D:
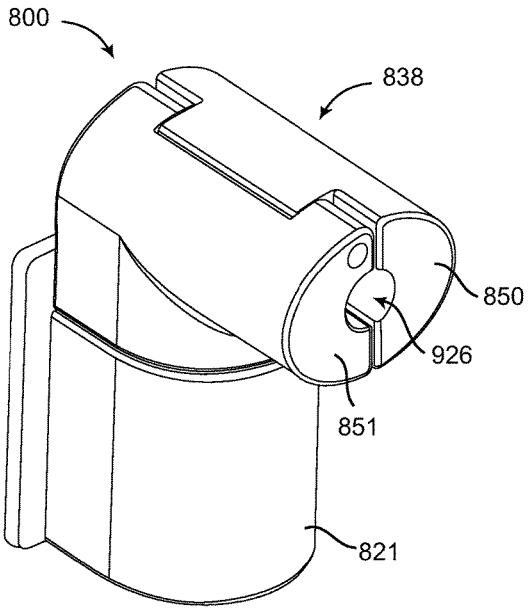
FIG. 12D is another perspective view of the locking device of FIG. 12A in accordance with an embodiment of the present disclosure.
Figure 12E:
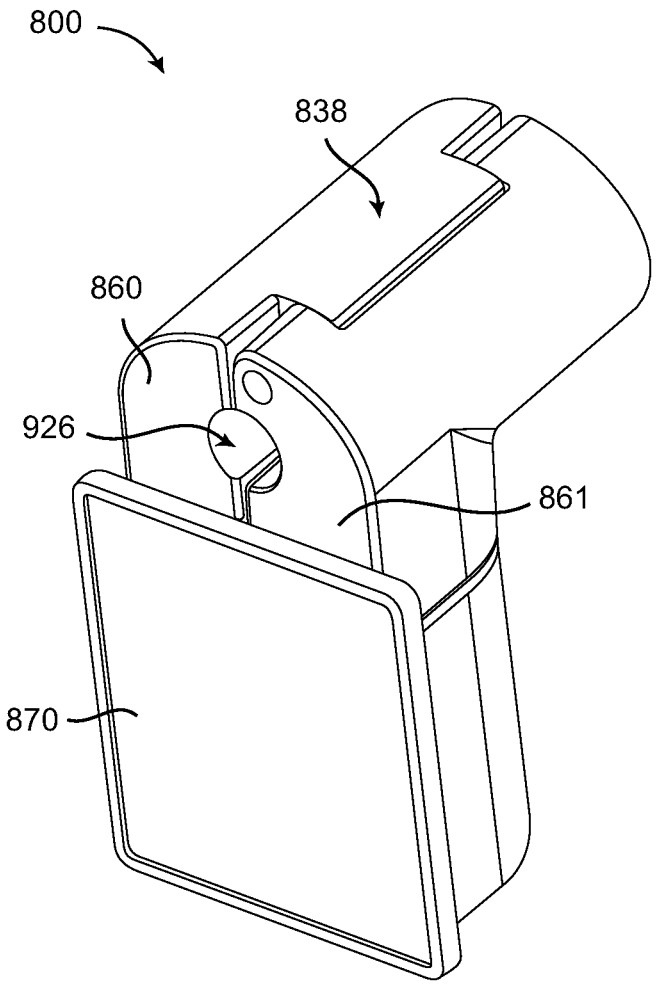
FIG. 12E is another perspective view of the locking device of FIG. 12A in accordance with an embodiment of the present disclosure.

Turning to FIG. 11D, a perspective view of locking device 700 with a portion of wire 12 of peg hook 10 held securely in channel 726. In use, locking device 700 may be used to prevent access to items disposed on peg hook 10 in an identical manner to locking device 300 as described above, therefore, the method for using locking device 700 will not be described again here.

Turning to FIGS. 12A-E, yet another embodiment of a locking device is shown in accordance with the present disclosure. As seen in FIGS. 12A-E, locking device 800 is shown in various views. Similar to the above-described embodiments, locking device 800 includes an outer housing 822 hingedly coupled to a pivoting member 830 via hinging mechanism 838, where hinging mechanism 838 will be described in greater detail below. When pivoting member 830 is pivoted such that pivoting member 830 achieves a closed position in relation to outer housing 822 (as shown in FIGS. 12A-E), channel 926 is formed. Channel 926 extends from the combined flat surface formed by side 851 of pivoting member 830 and side 850 of outer housing 822 to the combined flat surface formed by side 861 of pivoting member 830 and side 860 of outer housing 822. It is to be appreciated that the combined flat surface of side 851 and 850 are configured such that the combined flat surface formed by sides 851 and 850 extend out perpendicularly in relation to outer wall of base 821 of outer housing 822. It is to be appreciated that the flat surface formed by sides 851 and 850 of locking device 800 extend the length of channel 926 providing additional security advantages, as described below.

It is to be appreciated that in one embodiment, outer housing 822 of locking device 800 includes a flat surface 870 aligned with surfaces 860 and 861. Flat surface 870 is configured to receive a sticker displaying information.

Figure 13A:
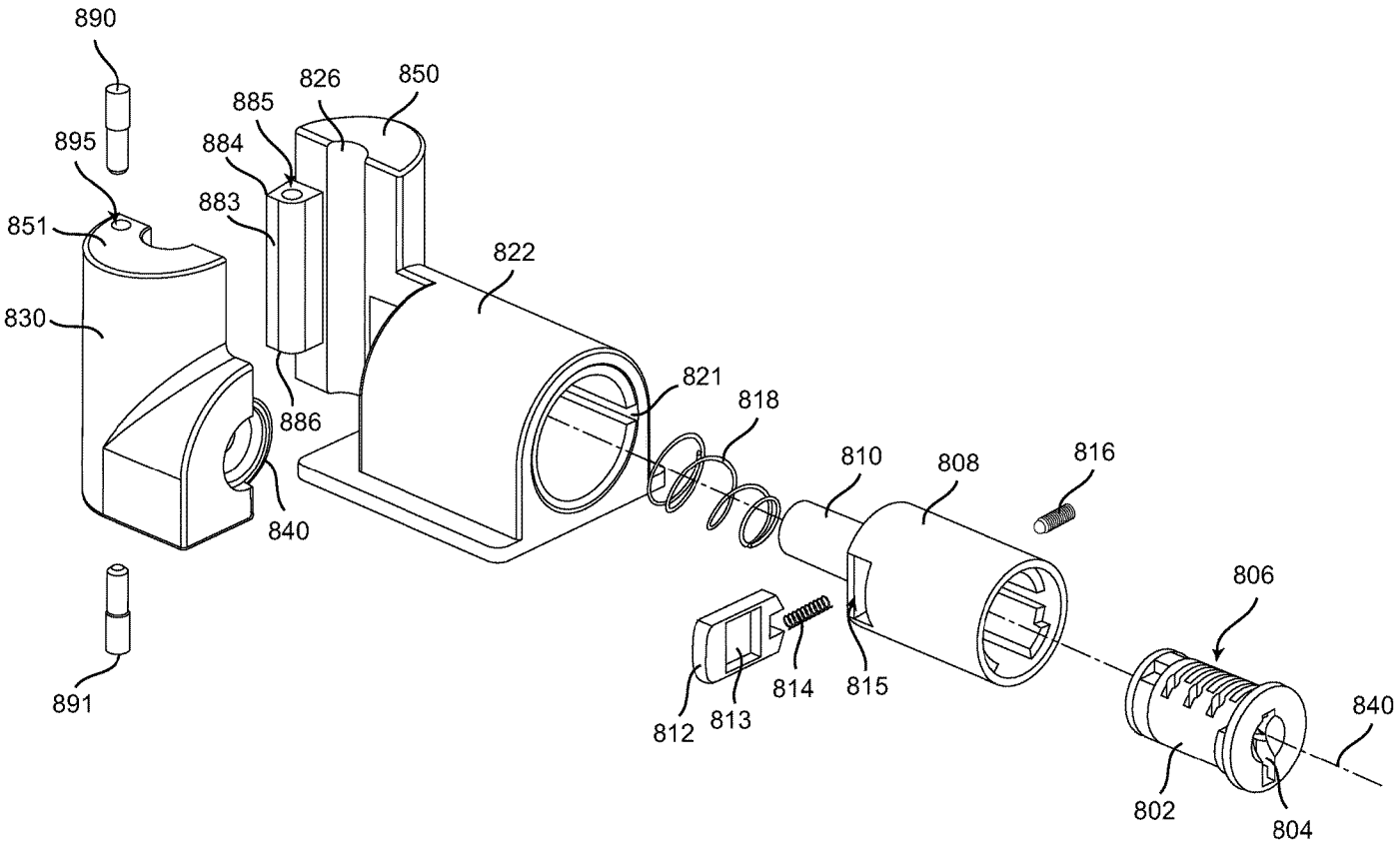
FIG. 13A is an exploded perspective view of the locking device of FIG. 12A in accordance with an embodiment of the present disclosure.
Figure 13B:
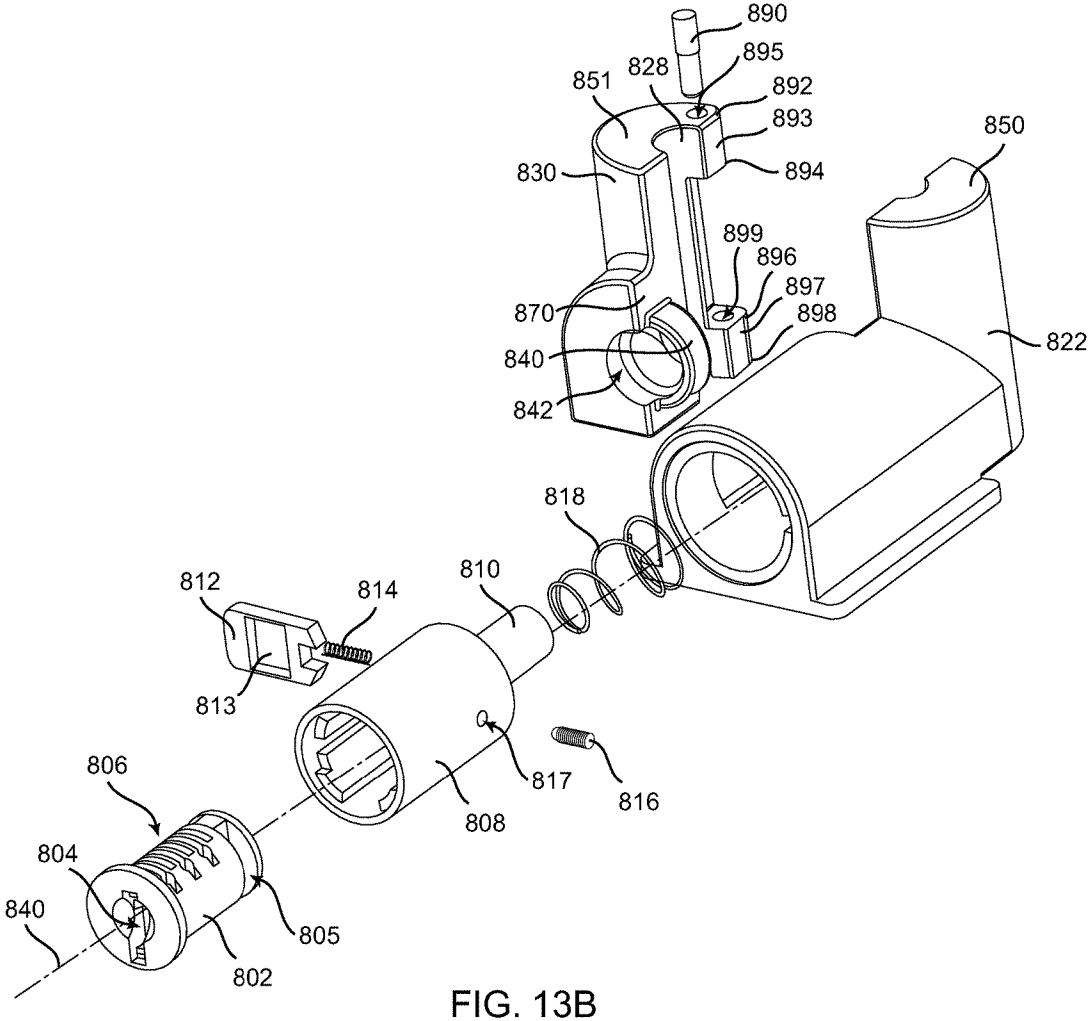
FIG. 13B is another exploded perspective view of the locking device of FIG. 12A in accordance with an embodiment of the present disclosure.
Figure 13C:
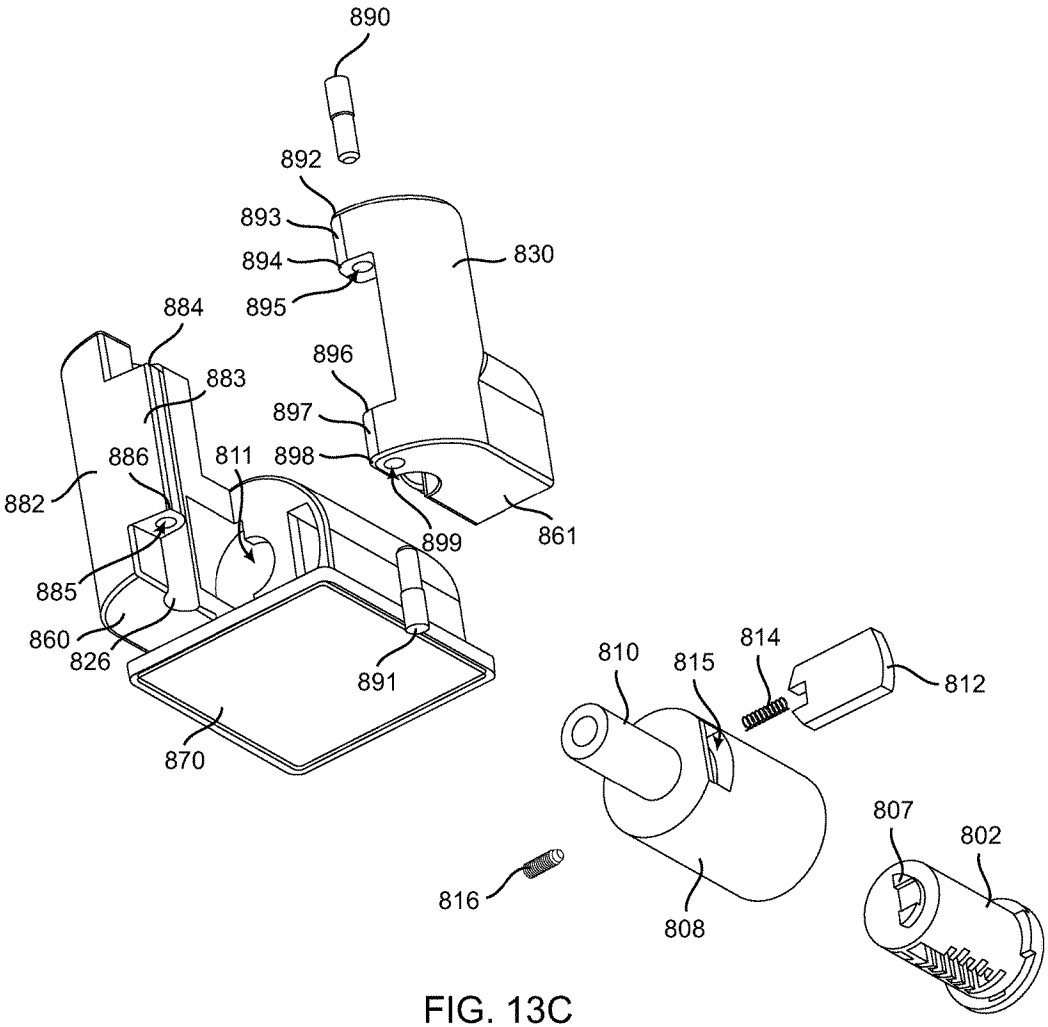
FIG. 13C is another exploded perspective view of the locking device of FIG. 12A in accordance with an embodiment of the present disclosure.

Referring to FIGS. 13A-C, various exploded perspective views of locking device 800 is shown in accordance with the present disclosure. The locking device 800 includes a cylinder plug 802, which includes a key hole 804, an arced channel 805 on an end opposite the key hole 804, and a plurality of tumblers 806. The cylinder plug 802 is disposed in a cylindrical shell 808 and retained therein by barrel pin 816. A longitudinal axis 840 of the cylinder plug 802 may be aligned with a longitudinal axis of the cylindrical shell 808. Barrel pin 816 is disposed in an aperture 817 through a wall of the cylindrical shell 808 in such a manner that the barrel pin 816 projects from both sides of the wall of the cylindrical shell 808. On the inner portion of the wall of the cylindrical shell 808, the barrel pin 816 extends into arced channel 805 of the cylinder plug 802 to rotatably retain the cylinder plug 802 in the cylindrical shell 808.

Figure 14:
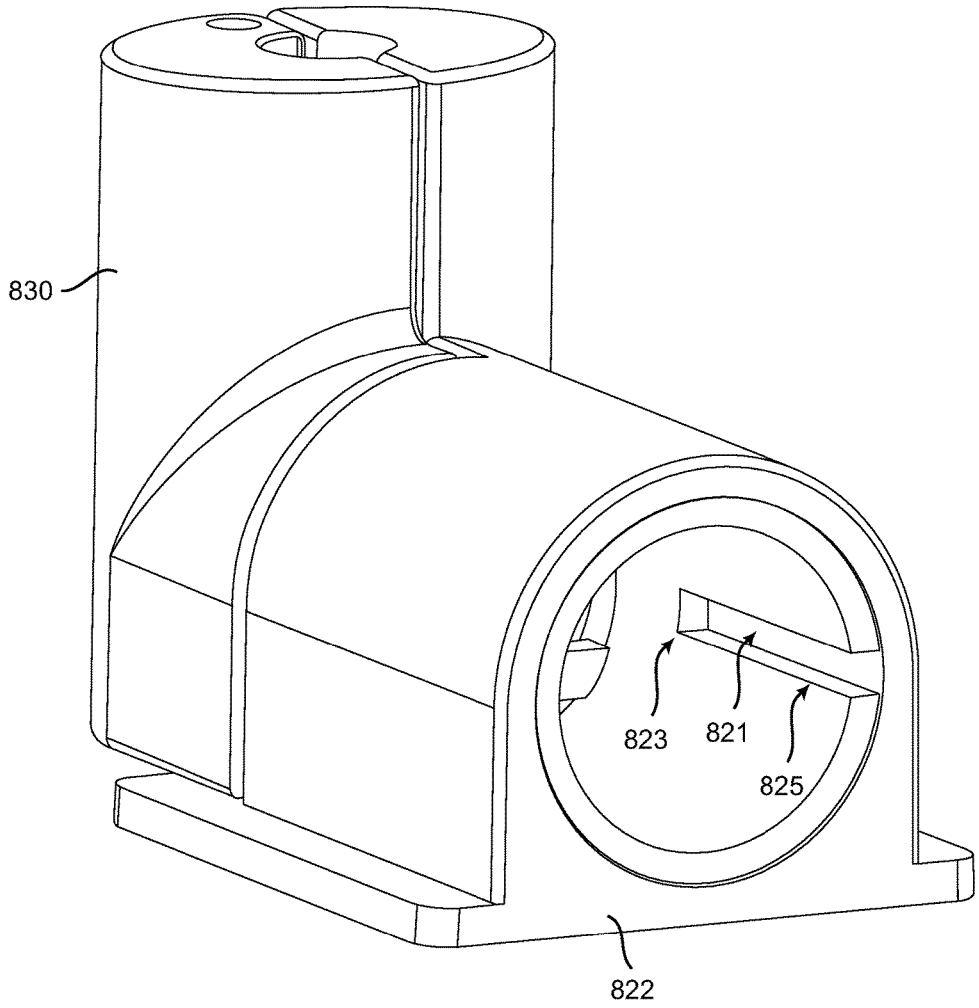
FIG. 14 is a perspective view of the interior of the locking device of FIG. 12A in accordance with an embodiment of the present disclosure.
Figure 15A:
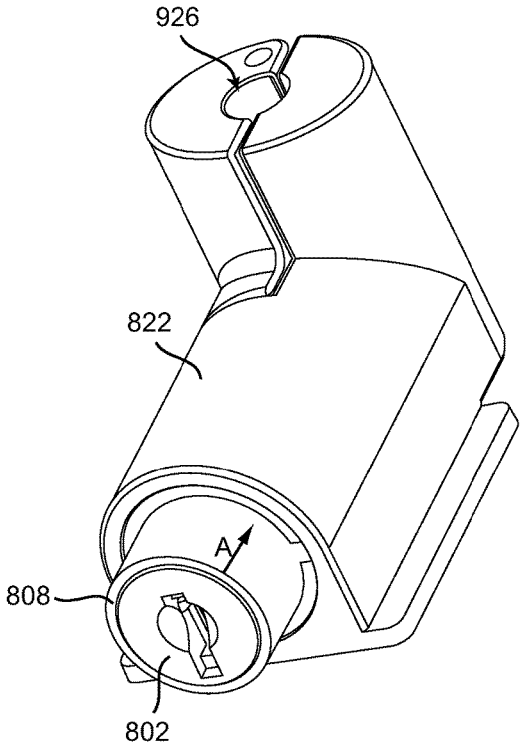
FIG. 15A is a perspective view of the locking device of FIG. 12A in an unlocked position in accordance with an embodiment of the present disclosure.
Figure 15B:
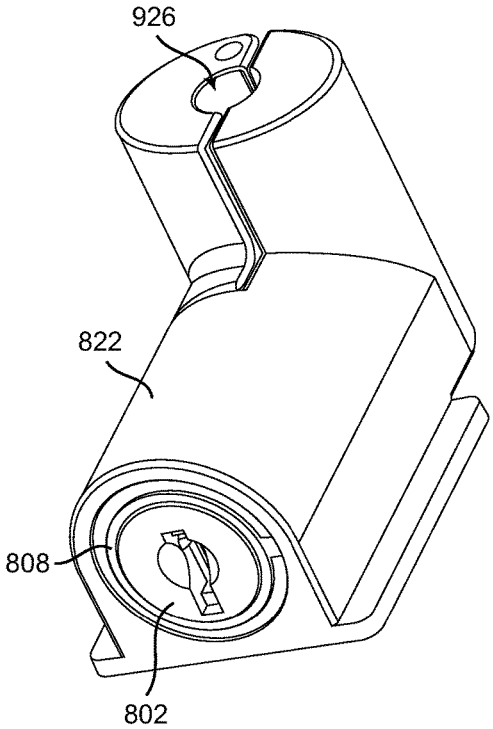
FIG. 15B is a perspective view of the locking device of FIG. 12A in a locked position in accordance with an embodiment of the present disclosure.

The cylindrical shell 808 includes a cylindrical projection or plunger 810. The cylindrical shell 808 is longitudinally aligned with and disposed in outer housing. The cylindrical shell 808 is biased away from the outer housing 822 by a barrel spring 818. The portion of the barrel pin 816 extending outside the wall of the cylindrical shell 808 rides in an elongated slot 821 in a wall of the outer housing 822, where elongated slot 821 is shown in FIGS. 13A and 14. The slot 821 controls the longitudinal front to back motion of the cylindrical shell 808 with respect to outer housing 822. When the locking device 800 is locked, the barrel pin 816 will be at the back 823 of the slot 821. When unlocked, the barrel pin 816 will be at the front 825 of the slot 821. For example, referring to FIG. 15A, a perspective view of locking device 800 is shown in an unlocked position in accordance with the present disclosure, where shell 808 and cylinder plug 802 is biased away from outer housing 822 by spring 818. In FIG. 15B, locking device 800 is shown in a locked position where shell 808 and cylinder plug 802 have been pressed in a direction A (indicated in FIG. 15A) towards outer housing 822 and locked into place, as will be described in greater detail below.

Figure 16A:
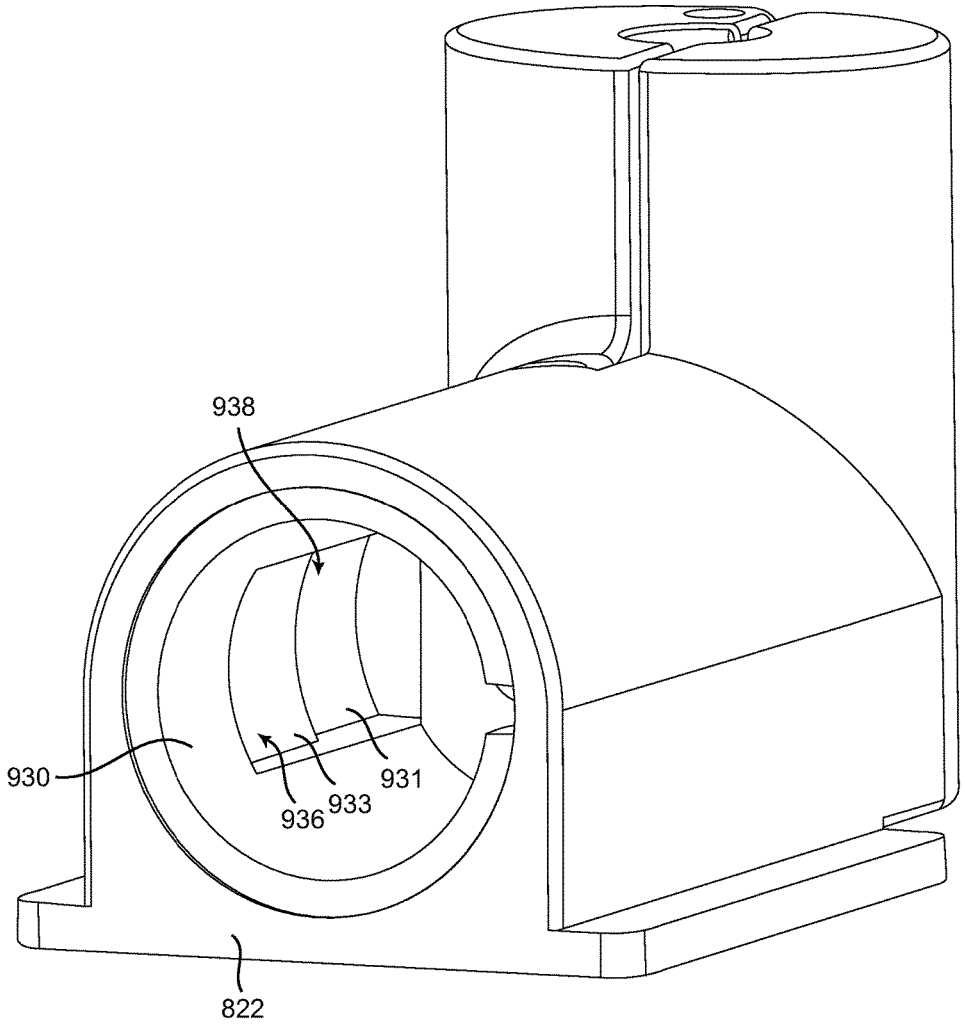
FIG. 16A is another perspective view of the interior of an outer housing of the locking device of FIG. 12A in accordance with an embodiment of the present disclosure.
Figure 16B:
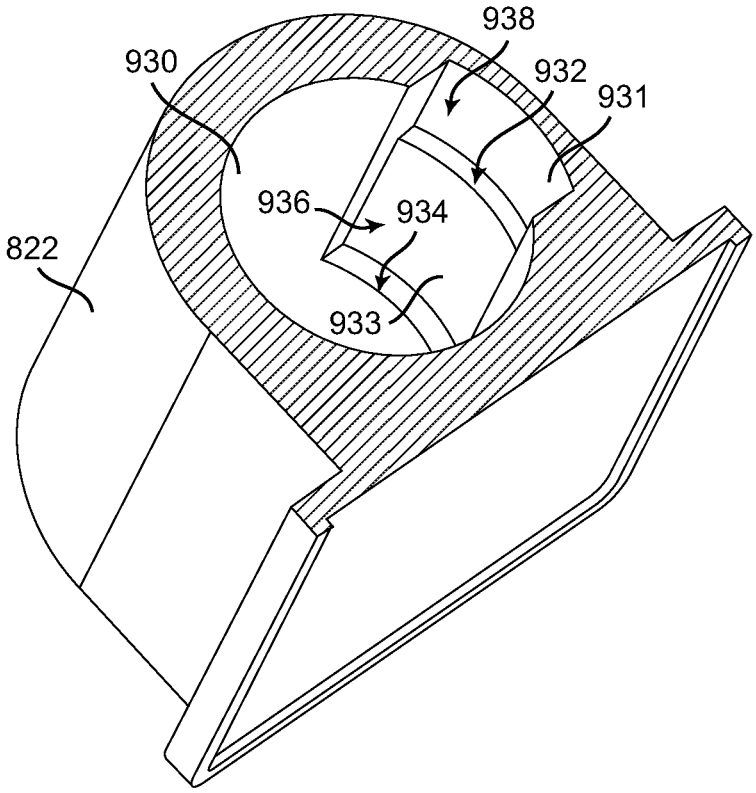
FIG. 16B is a perspective cross-sectional view of an outer housing of the locking device of FIG. 12A in accordance with an embodiment of the present disclosure.

Referring to FIG. 16A, a perspective view of locking device 800 revealing the interior of outer housing 822 is shown in accordance with the present disclosure. As shown in FIG. 16A, outer housing 822 includes an inner wall 930. Inner wall 930 includes a first slot 936, where first slot 936 includes a first embedded surface 933. Furthermore, inner wall 930 includes a second slot 938, where second slot 938 includes a second embedded surface 931. It is to be appreciated that surface 931 is disposed closer to the exterior of outer housing 822 than surface 933 (i.e., surface 933 is disposed closer to a surface of inner wall 930 than surface 931). Referring to FIG. 16B, a cross-sectional view of outer housing 822 is shown in accordance with the present disclosure. As shown in FIG. 16B, slot 938 includes surface or ledge 932, where embedded surface 931 is disposed perpendicularly to a surface 932 and surface 932 is disposed perpendicularly to surface 933. Furthermore, slot 936 includes surface or ledge 934, where embedded surface 933 is disposed perpendicularly to surface 934 and surface 934 is disposed perpendicularly to inner wall 930. It is to be appreciated that the combination of surface 931 and 932 form a first slot disposed in the inner surface 930 of inner body 820 and the combination of surface 934 and 933 form a second slot disposed in the inner surface 930 of outer housing 822.

Referring again to FIGS. 13A-C, a plunger locking bolt 812 and bolt spring 814 are disposed in slot 815 of cylindrical shell 808. It is to be appreciated that plunger locking bolt 812 includes a rectangular cavity 813. Bolt spring 814 biases the plunger locking bolt 812 outwardly away from the walls of shell 808. For example, referring to FIG. 17A, plunger locking bolt 812 is shown inserted into slot 815 and biased in a direction away from shell 808 (as indicated by arrow A) via bolt spring 814, where bolt spring 814 is coupled to plunger locking bolt 812 and an interior wall of shell 808. When locking device 800 is in a locked position, as shown in FIG. 15A, surface 911 of plunger locking bolt 812 (shown in FIG. 17B) is biased toward embedded surface 931 by spring 814 and surface 909 of plunger locking bolt 812 (shown in FIG. 17B) is biased towards surface 932 by spring 818; therefore, a portion of plunger locking bolt 812 is disposed in slot 938. It is to be appreciated, as stated above, in the locked position, barrel pin 816 will be disposed in the back 823 of slot 821, and will not allow shell 808 and plug 802 to be pushed further into outer housing 822. In this way, in a locked position, shell 808 and plug 802 cannot be pressed further into inner body 820 (i.e., in a direction towards pivoting member 830) by a user because of barrel pin 816 meets back 823 of slot 821 and shell 808 and plug 802 cannot be biased further away from inner body 820 by spring 818 because surface 909 of plunger locking bolt 812 meets surface 932. When locking device 800 is in an unlocked position, as shown in FIG. 15B, surface 911 of plunger locking bolt 812 is biased toward embedded surface 933 by spring 814 and surface 909 of plunger locking bolt 812 is biased toward surface 934 by spring 818; therefore, plunger locking bolt 812 is partially disposed in slot 936. In this way, shell 808 and plug 802 cannot be biased further away from inner body 820 by spring 818 because of surface 909 of plunger locking bolt 812 and surface 934.

Figure 17A:
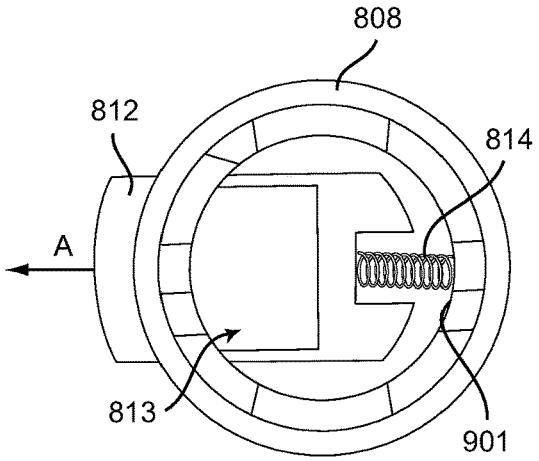
FIG. 17A is a view of a cylindrical shell and a plunger locking bolt of the locking device of FIG. 12A in accordance with an embodiment of the present disclosure.
Figure 17B:
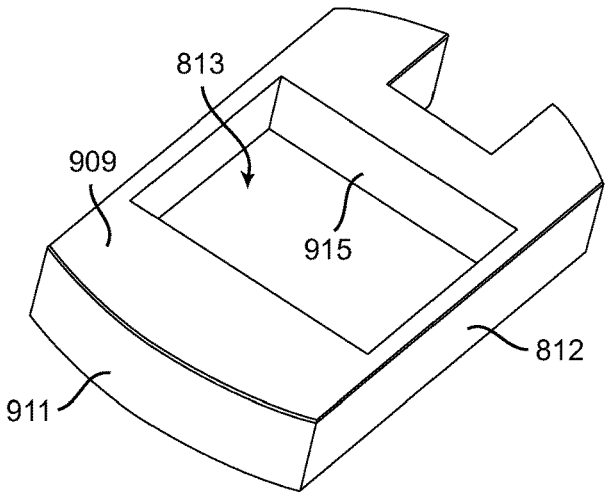
FIG. 17B is a perspective view of a plunger locking bolt of the locking device of FIG. 12A in accordance with an embodiment of the present disclosure.
Figure 17C:
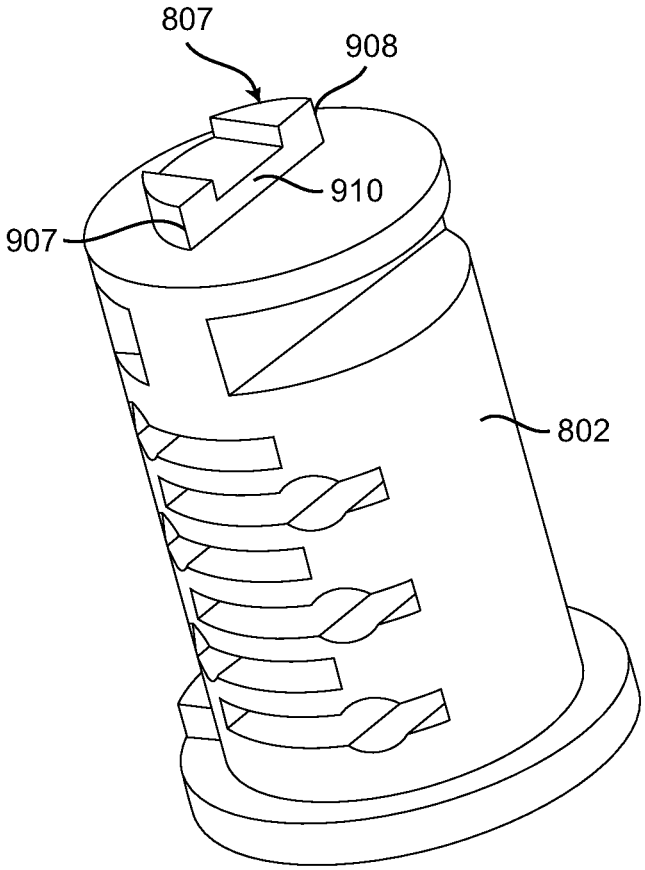
FIG. 17C is a perspective view of a cylindrical plug of the locking device of FIG. 12A in accordance with an embodiment of the present disclosure.
Figure 17D:
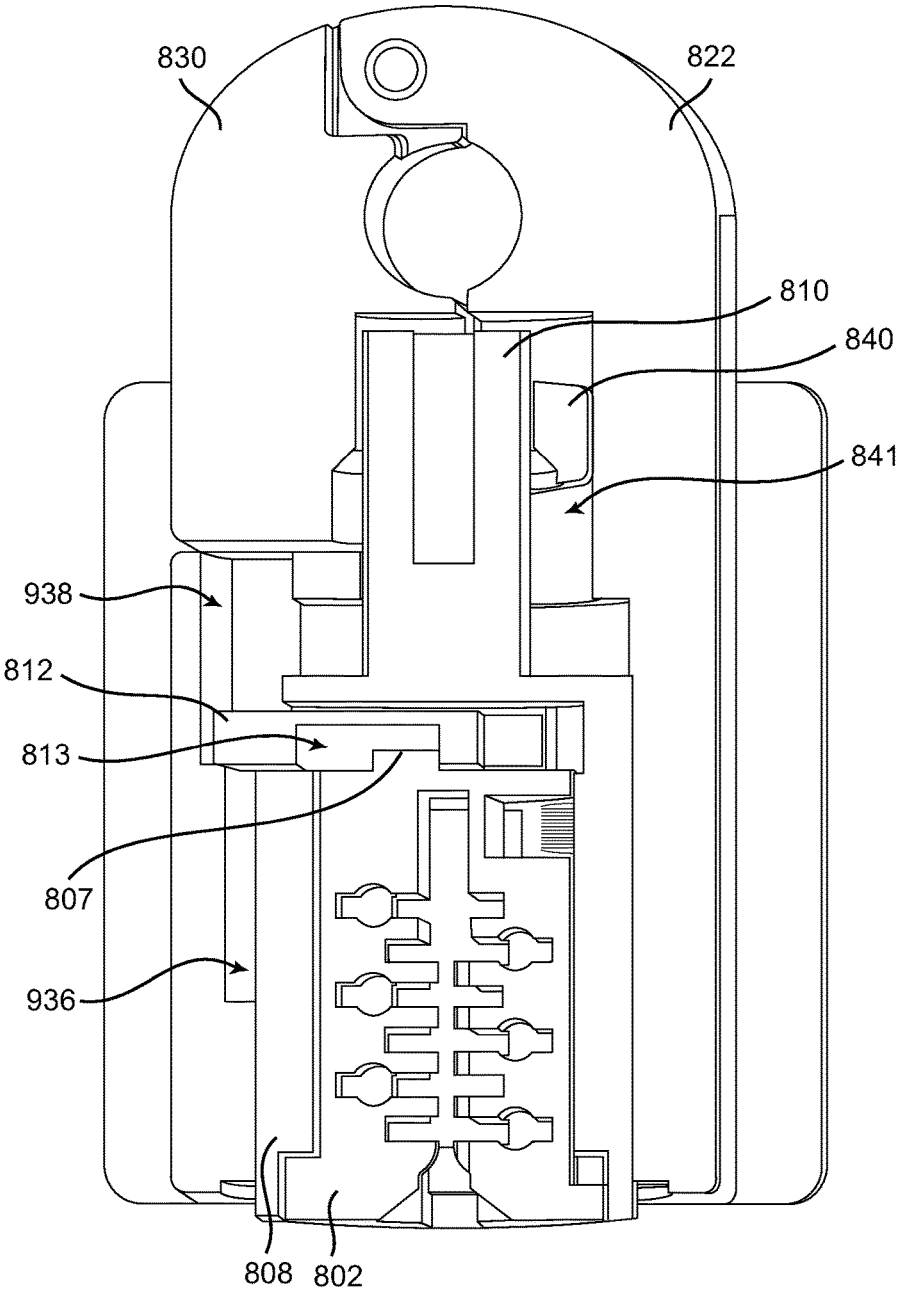
FIG. 17D is a cross-sectional view of the locking device of FIG. 12A in accordance with an embodiment of the present disclosure.

Referring to FIG. 17B, a perspective view of plunger locking bolt 812 is shown in accordance with the present disclosure. As seen in FIG. 17B, plunger locking bolt 812 includes a surfaces 909 and 911, as described above, and also includes surface 915 disposed in cavity 813. Referring to FIG. 17C, cylinder plug 802 is shown in accordance with the present disclosure. Cylinder plug 802 includes engaging element 807, where engaging element 807 includes a surface 910 having an end 907 and opposite end 908. It is to be appreciated that in locking device 800 engaging element 807 is disposed in cavity 813, such that surfaces 910 and 915 are in contact. For example, referring to FIG. 17D, a cross-sectional view of locking device 800 is shown in accordance with the present disclosure. In FIG. 17D, engaging element 807 can be seen disposed in cavity 813 and plunger locker bolt 812 can be seen disposed in slot 938.

When a proper key is inserted into key hole 804 creating a shear line to allow the cylindrical plug 802 to rotate clockwise, end 908 of surface 910 of engaging element 807 pushes surface 915 of plunger locking bolt 812 towards the inner wall 901 of shell 808 in a direction opposite to direction A shown in FIG. 17A. It is to be appreciated that if the key inserted into key hole 804 is rotated counterclockwise, end 907 of surface 910 of engaging element 807 pushes surface 915 of plunger locking bolt 812 towards the inner wall 901 of shell 808 in a direction opposite to direction A shown in FIG. 17A. In this way, when locking device 800 is in a locked position, i.e., the end of plunger locking bolt 812 closest to surface 911 is disposed in slot 938, and a proper key is inserted into key hole 804 and rotated, engaging element 807 will draw or pull plunger locking bolt 812 towards the interior of shell 808 and spring 818 will push or bias shell 808 and plug 802 away from outer housing 822 until surface 909 of plunger locking bolt 812 meets surface 934, thus disposing plunger locking blot 812 in slot 936 so that locking device 800 can be in an open position (as shown in FIG. 15A).

As stated above, pivoting member 830 is hingedly coupled to outer housing 822 via hinging mechanism 838. In one embodiment, hinging mechanism 838 includes a first hinging element 883, second hinging element 893, third hinging element 897, and hinging pins 890 and 891, shown in FIGS. 13A-C. Specifically, as shown in FIGS. 13A-C, outer housing 822 includes hinging element 883, where hinging element 883 includes a circular channel 885 extending from end 884 of hinging element 883 to opposite end 886 of hinging element 883. Pivoting member 830 includes hinging element 893, where hinging element 893 includes a circular channel 895 extending from end 892 of hinging element 893 to opposite end 894 of hinging element 893. Furthermore, pivoting member 830 includes hinging element 897, where hinging element 897 includes a circular channel 899 extending from end 896 of hinging element 897 to opposite end 898 of hinging element 897. It is to be appreciated that in one embodiment channel 885 is two separate channels, where one channel is disposed on end 886 and another channel is disposed on end 884 of hinging element 883.

Figure 18A:
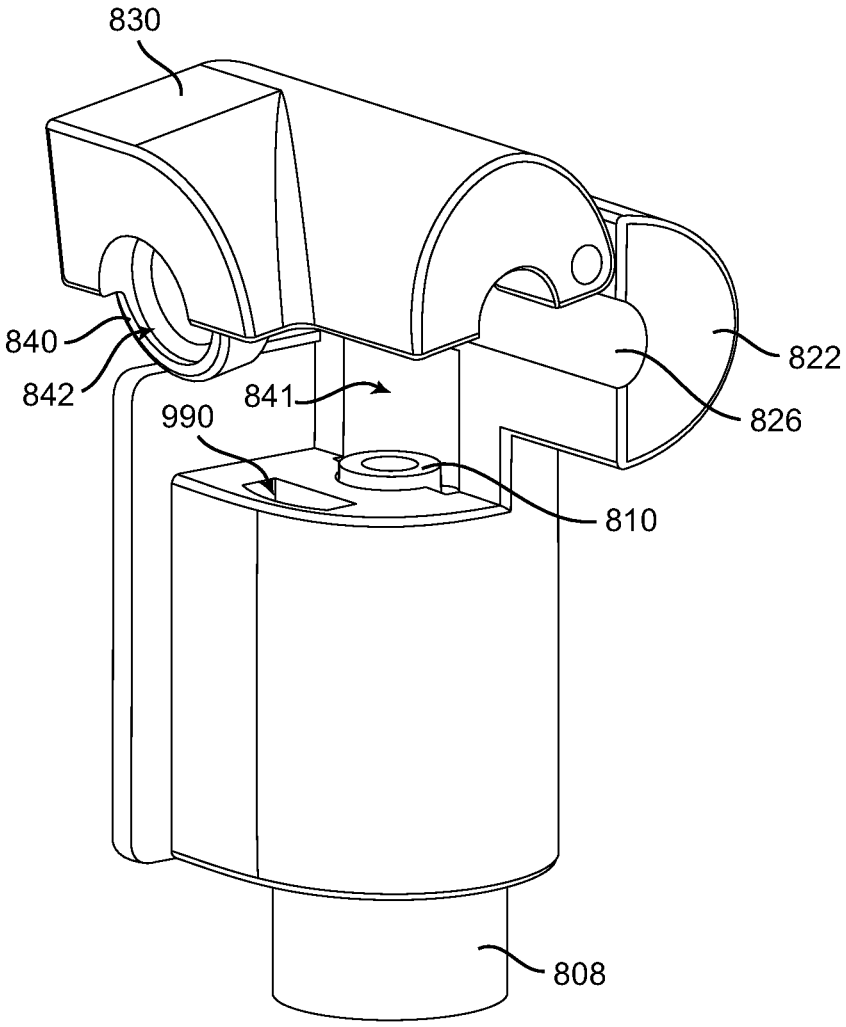
FIG. 18A is a perspective view of the locking device of FIG. 12A in an open position in accordance with an embodiment of the present disclosure.
Figure 18B:
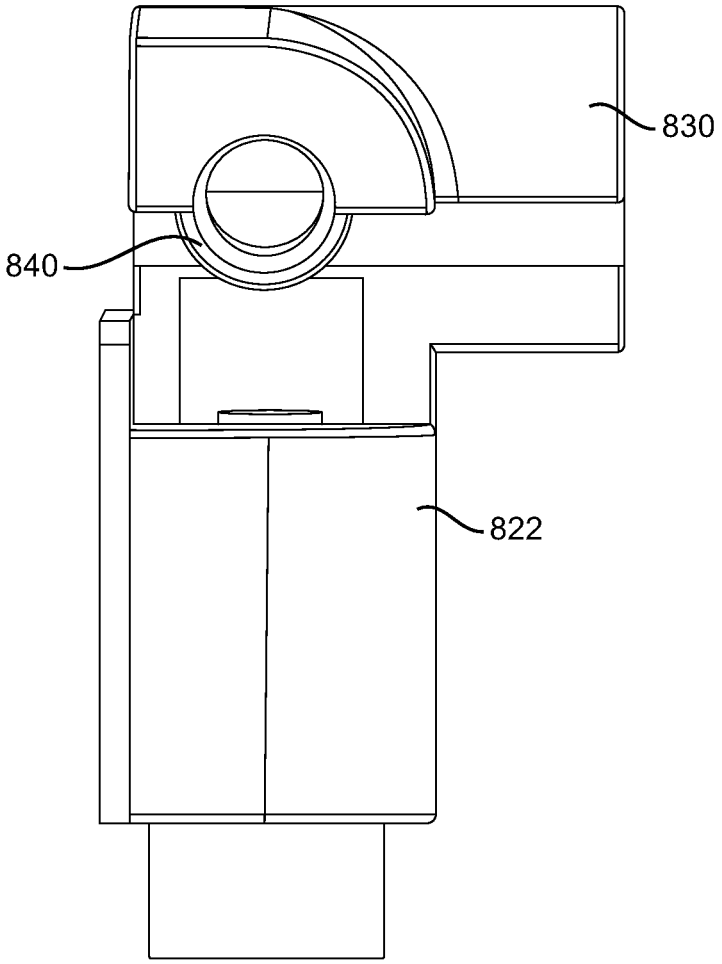
FIG. 18B is a side view of the locking device of FIG. 12A in an open position in accordance with an embodiment of the present disclosure.
Figure 18C:
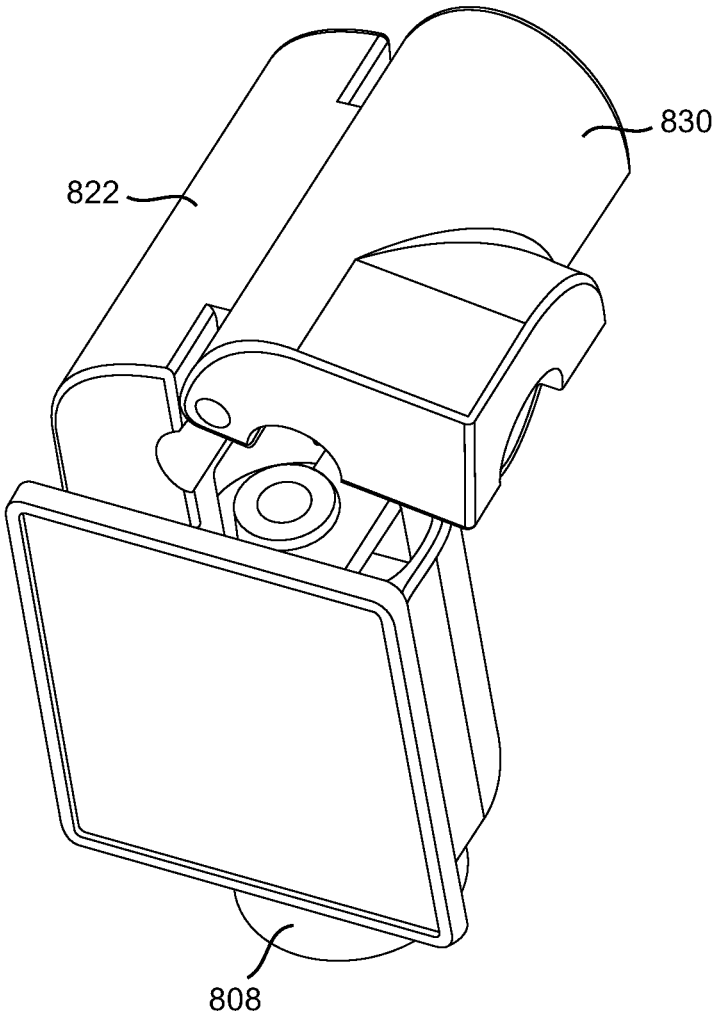
FIG. 18C is another perspective view of the locking device of FIG. 12A in an open position in accordance with an embodiment of the present disclosure.

In one embodiment, pin 890 couples hinging element 893 to hinging element 883, where pin 890 is partially disposed in end 884 of channel 885 and pin 890 is partially disposed in end 892 of channel 895. Furthermore, pin 891 couples hinging element 883 to hinging element 897, where pin 891 is partially disposed in end 886 of channel 885 and pin 891 is partially disposed in side 896 of channel 899. In this way, pivoting member 830 can be pivoted about hinging mechanism 838 to achieve an open or closed position. Referring to FIGS. 18A-C, locking device 800 is shown in an open position in accordance with the present disclosure. It is to be appreciated that locking device 800 is shown in a closed position in FIGS. 12A-E. It is to also to be appreciated that, in one embodiment, locking device 800 includes aperture 990, where slot 938 is disposed in aperture 990.

As shown in FIGS. 13A-C, pivoting member 830 includes peg groove 828 (i.e., a semi-cylindrical groove), where peg groove 828 extends from side 851 to side 861 of pivoting member 830. Furthermore, outer housing 822 includes peg groove 826 (i.e., a semi-cylindrical groove), where peg groove 826 extends from side 850 to side 860 of outer housing 822. When pivoting member 830 is pivoted about hinging mechanism 838 to achieve a closed position, peg grooves 826 and 828 form channel 926, where channel 926 extends from the combined flat surface formed by sides 850 and 851 to the combined flat surface formed by sides 860 and 861.

Figure 19A:
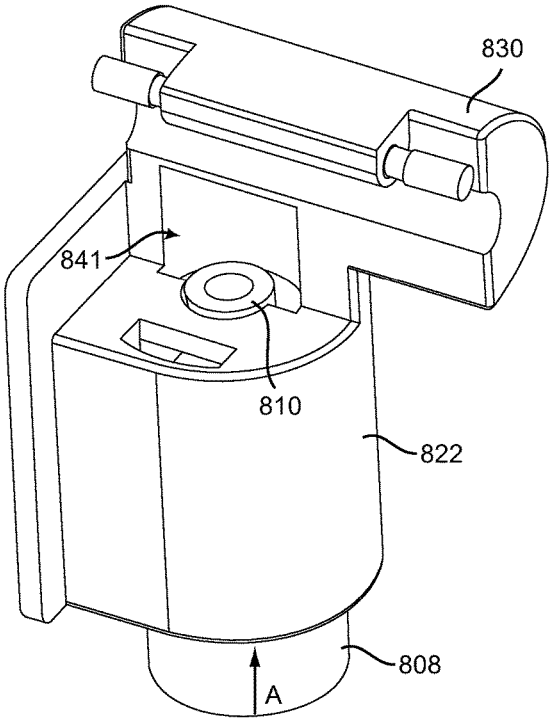
FIG. 19A is another perspective view of the locking device of FIG. 12A in an unlocked position in accordance with an embodiment of the present disclosure.
Figure 19B:
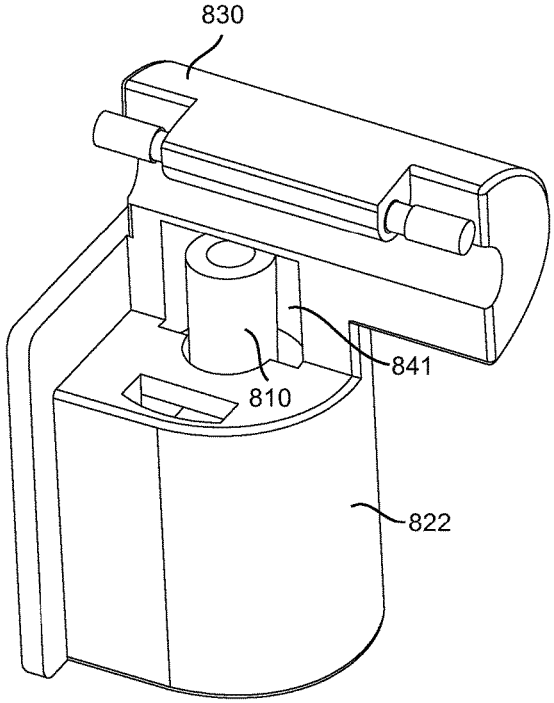
FIG. 19B is another perspective view of the locking device of FIG. 12A in a locked position in accordance with an embodiment of the present disclosure.

Below peg groove 826, outer housing 822 includes aperture 811 (shown in FIG. 13C), where at least a portion of projection 810 is disposed in aperture 811. Furthermore, outer housing 822 includes slot 841 (shown in FIG. 18A), where slot 841 is configured to receive a lug 840 coupled to pivoting member 830, as will be described below. The slot 841 at least partially encloses aperture 811, which allows cylindrical projection 810 to enter the area formed by the slot 841. When cylindrical shell 808 is pressed toward the interior of outer housing 822, projection 810 will move along longitudinal axis 840 through aperture 811 and into slot 841. Referring to FIG. 19A locking device 800 is shown in an unlocked position with pivoting member 830 removed for clarity, where shell 808 has not been advanced in along longitudinal axis 840 into the interior of outer housing 822. Referring to FIG. 19B, locking device 800 is shown in a locked position with pivoting member 830 removed for clarity, where shell 808 has been advanced along longitudinal axis 840 into the interior of outer housing 822. As seen in FIG. 19B, when cylindrical shell 808 is pressed in a direction A (indicated in FIG. 19A), projection 810 also advances in a direction A and is disposed in slot 841.

Figure 19C:
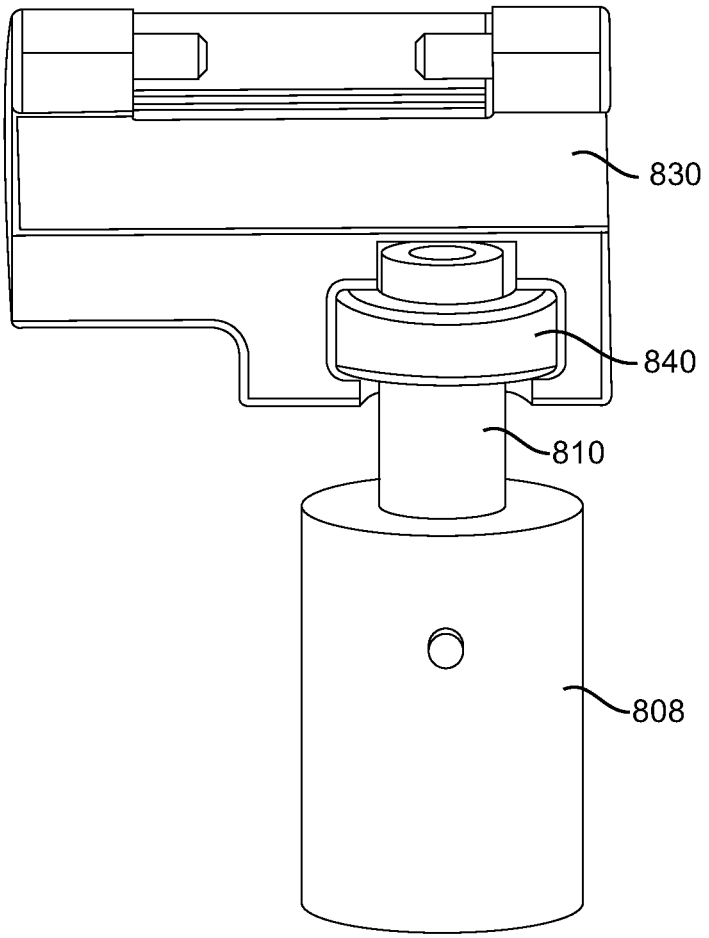
FIG. 19C is a side view of a projection of the locking device of FIG. 12A disposed in an aperture of a pivoting member of the locking device of FIG. 12A in accordance with an embodiment of the present disclosure.

Referring again to FIGS. 13A-C and FIGS. 18A-C, pivoting member 830 further includes lug 840, which extends out perpendicularly from the flat inner surface 870 of pivoting member 830. Lug 340 includes aperture 342. When pivoting member 830 is pivoted about hinge mechanism 838 to achieve a closed position in relation to outer housing 822, slot 841 is configured to receive at least a portion of lug 840. It is to be appreciated that a portion of lug 840 disposed in slot 841 when locking device 800 is in a closed position in shown in FIG. 17D. When pivoting member 830 is pivoted about hinging mechanism 838 to achieve a closed position in relation to outer housing 822, aperture 842 on lug 840 is aligned with projection 810 such that when projection 810 is extended by pressing cylindrical shell 808 along longitudinal axis 840 into the interior of outer housing 822, projection 810 passes through aperture 842 of lug 840 on pivoting member 830. It is to be appreciated that FIG. 19C shows projection 810 disposed in aperture 842 of lug 840, where outer housing 822 is removed for clarity. Furthermore, it is to be appreciated that FIG. 17D, shows locking device in a locked position, where projection 810 is disposed in aperture 842 of lug 840.

In use, pivoting member 830 of locking device 800 is pivoted about hinging mechanism 838 such that pivoting member 830 is in an open position in relation to outer housing 822, as shown in FIGS. 18A-C. While pivoting member 830 is in an open position, a portion of wire 12 (preferably, a portion close to bend 14) of peg hook 10 is placed in peg groove 826 on outer housing 822. Then, pivoting member 830 is pivoted about hinging mechanism 838 such that pivoting member 830 achieves a closed position in relation to outer housing 822, as shown in FIG. 12A-E. When pivoting member 830 is in a closed position in relation to outer housing 822, the portion of wire 12 that was placed in peg groove 826 will now be secured in channel 926 with end 20 of wire 12 entering channel 926 on side 851 of pivoting member 830 and 850 of outer housing 822, and end 16 of wire 12 exiting channel 926 on side 861 of pivoting member 830 and 860 of outer housing 851.

Next, while maintaining pivoting member 830 in a closed position in relation to outer housing 822, locking device 800 is actuated (i.e., locked) by pressing the cylindrical shell 808 into the outer housing 822 along longitudinal axis 840 in the direction of arrow A as shown in FIGS. 15A and 19A. When cylindrical shell 808 is pressed in the direction of arrow A along longitudinal axis 840, projection 810 also moves in the direction of arrow A and passes through aperture 842 of lug 840 on pivoting member 830. Once projection 810 has passed through aperture 840, projection 810 is secured such that projection 810 cannot be moved in any direction (i.e., plunger locking bolt 812 is partially disposed in slot 838 of outer housing 822). Thus, since projection 810 is positioned through aperture 842 such that projection 810 is holding lug 840 in a fixed position and lug 840 is fixed to pivoting member 830, pivoting member 830 is held in a closed position in relation to outer housing 822 and cannot be pivoted while in this closed and locked position. In this manner, the locking device 800 is securely locked onto the peg hook 10 preventing removal of any items disposed thereon.

To unlock and remove the locking device 800, a correct key is inserted into key hole 804 and key 305 is rotated clockwise (or counterclockwise), releasing plunger locking bolt 812 from slot 938 and cylindrical shell 808 is forced away from the outer housing 822 via barrel spring 818, disposing plunger locking bolt 812 in slot 936. When cylindrical shell 808 is biased away from outer housing 822, projection 810 is drawn back in the same direction as cylindrical shell 808 (the direction opposite to arrow A in FIG. 18A), thereby removing projection 810 from aperture 840 of lug 842 on pivoting member 830. When projection 810 is drawn back and removed from aperture 840, pivoting member 830 may once again achieve an open position in relation to outer housing 822 (via hinging mechanism 838) to allow the portion of wire 12 that was previously disposed in channel 926 to be released, therefore allowing the lock to be removed to access the desired merchandise.

It is to be appreciated that the pivoting design of locking devices 100, 300, 500, 700, 800 provide a distinct advantage over locking devices that do not have pivoting members. In conventional locking devices that do not have pivoting members, to secure a peg hook using the locking device, the peg hook must be slid through an opening in the locking device to be secured by the locking device. Therefore, the opening in the conventional locking device without the pivoting member design must be chosen such that peg hook as designed can slide through the locking device. However, because locking devices 100, 300, 500, 700, 800 use pivoting members, a peg hook may be chosen to be secured in locking device 100/300/500/700/800 that would not be able to slide over the chosen peg hook when in a closed position (i.e., the pivoting member is pivoted such that it is in a closed position in relation to the outer housing as described in the above embodiments). For instance, a peg hook with a more pronounced bend than would be possible for use with a locking device that does not have pivoting members may be used if desired. Even with a peg hook with a very pronounced bend, the pivoting design of locking device 100/300/500/700/800 allows it to be pivoted to achieve an open position to accept the flat portion of a peg hook to be secured on a peg hook instead of being slide over the bend peg hook while in a closed position.

Another advantage of locking devices 100, 300, 500, 700, 800 is that by varying the lengths and diameters for channels 226, 426, 526, 726, 926 a wider variety of peg hooks may be used. For instance, the length of channel 226/426/526/726/926 of locking device 100/300/500/700/800 will be chosen such that when locking device 100/300/500/700/800 is securely locked onto peg hook 10, bend 14 in peg hook 10 prevents locking device 100/300/500/700/800 from being removed from peg hook 10 by sliding locking device 100/300/500/700/800 over bend 14 towards end 16 of peg hook 10. However, it is to be appreciated that if a sufficiently long length is chosen for channel 226/426/526/726/926, a thinner peg hook may be chosen for use with locking device 100/300/500/700/800. Even if the diameter of channel 226/426/526/726/926 is appreciably greater than the diameter of a peg hook, if the channel 226/426/526/726/926 is sufficiently long, the locking device 100/300/500/700/800 will not be able to be removed from the peg hook. Although, if a shorter length is chosen for channel 226/426/526/726/926, then the diameter of channel 226/426/526/726/926 may be closer in size to the diameter of the wire of the chosen peg hook to ensure the locking device cannot be easily removed from the peg hook. Therefore, in certain embodiments, the diameter of the channel 226/426/526/726/926, is proportional to the length of channel 226/426/526/726/926.

Additionally, if the peg hook 10 is fitted with a spherical ball on end 16, the radius of channel 226/426/526/726/926 of locking device 100/300/500/700/800 may be chosen such that, while wire 12 of peg hook 10 will fit inside channel 226/426/526/726/926, the ball on end 16 of peg hook 10 will be too large to fit through channel 226/426/526/726/926. Therefore, when locking device 100/300/500/700/800 is securely locked onto peg hook 10, the sufficiently small diameter of channel 226/426/526/726/926 will prevent the ball on the end of peg hook 10 from passing through channel 226/426/526/726/926 preventing removal of any items disposed on peg hook 10.

Also, it is to be appreciated that, in some embodiments, the locking device 100/300/500/700/800 may be used with any wire 12, peg hook, strike plate, and any device with an extending wire arm, with or without a bend in the wire. The locking device 100/300/500/700/800 may be configured to clamp the side of the wire, either at a straight section or bent section of the wire.

It is also to be appreciated that products are also displayed and stored behind doors, drawers, and sliding doors in store fixtures. The locking function of the locking device 100/300/500/700/800 of the present disclosure can be extended to any item with a protruding locking pin, e.g., a trailer hitch can use this design to lock down over the pin. For showcase retrofit purposes, being able to add either a locking pin or lockable strike to a showcase that does not have locks enables a lock to be affixed to different doors without the significant cost of labor to drill a mounting hole. Several mounting screws may affix the pins or strikes to allow the plunger lock to prevent the opening of the fixture.

It is also to be appreciated that the various features shown and described are interchangeable, that is, a feature shown in one embodiment may be incorporated into another embodiment.

It is further to be appreciated that the teachings of the present disclosure may apply to other fixtures not shown or described. For example, a school or gym locker may include two members with aligning holes that would conventionally accept a pad lock to secure the locker. The locking devices of the present disclosure may be adapted so the projection or plunger 110/310 enters the aligning holes to secure the contents of the locker.

While the disclosure has been shown and described with reference to certain preferred embodiments thereof, it will be understood by those skilled in the art that various changes in form and detail may be made therein without departing from the spirit and scope of the disclosure.

Furthermore, although the foregoing text sets forth a detailed description of numerous embodiments, it should be understood that the legal scope of the invention is defined by the words of the claims set forth at the end of this patent. The detailed description is to be construed as exemplary only and does not describe every possible embodiment, as describing every possible embodiment would be impractical, if not impossible. One could implement numerous alternate embodiments, using either current technology or technology developed after the filing date of this patent, which would still fall within the scope of the claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

What is claimed is:

1. A locking device comprising:

an outer housing including an outer wall and a hollow cylindrical interior having a first longitudinal axis and an interior wall, the interior wall including a slot, the outer housing further including a first peg groove extending from a first side of the outer housing to a second side of the outer housing, the first side of the outer housing opposite to the second side of the outer housing, the first peg groove traversing the first longitudinal axis;

a cylindrical shell including a projection, the cylindrical shell being at least partially disposed in the interior of the outer housing and moveable within the interior along the first longitudinal axis;

a cylinder plug including a key hole and an arced channel, the cylindrical plug contained within the cylindrical shell and rotatable relative to the cylindrical shell when a proper key is inserted in the key hole and rotated;

a barrel pin disposed through a wall of the cylindrical shell, such that a first portion of the barrel pin projects toward the interior of the cylindrical shell into the arced channel to rotatably retain the cylinder plug in the cylindrical shell, and a second portion of the barrel pin projects toward the exterior of the cylindrical shell into the slot to control the longitudinal motion of the cylindrical shell; and a pivoting member hingedly coupled to the outer housing by a hinging mechanism, the pivoting member including a first aperture, the pivoting member further including a second peg groove extending from a first side of the pivoting member to a second side of the pivoting member, the first side of the pivoting member opposite to the second side of the pivoting member, the pivoting member is pivoted about the hinging mechanism to achieve an open position relative to the outer housing or a closed position relative to the outer housing, wherein, in the closed position, the first aperture aligns with the first longitudinal axis and the first peg groove is disposed adjacent to the second peg groove to form a channel extending from the first side of the outer housing and the first side of the pivoting member to the second side of the outer housing and the second side of the pivoting member;

wherein the first peg groove is configured to receive a portion of a wire when the pivoting member is in the open position relative to the outer housing, the pivoting member is pivoted about the hinging mechanism to achieve the closed position relative to the outer housing enclosing the portion of the wire in the channel, and, in the closed position, the cylindrical shell is advanced long the first longitudinal axis to extend at least a portion of the projection through the first aperture to secure the pivoting member in the closed position.

2. The locking device of claim 1, wherein the pivoting member further includes a lug extending perpendicularly from a surface of the pivoting member, the lug including the first aperture.

3. The locking device of claim 2, wherein the outer housing includes a first slot configured to receive at least a portion of the lug when the pivoting member is in the closed position relative to the outer housing.

4. The locking device of claim 1, wherein the first side of the outer housing and the first side of the pivoting member extend out perpendicularly past the outer wall of the outer housing.

5. The locking device of claim 1, wherein the outer housing includes a first extension member on the first side of the outer housing extending the first peg groove out perpendicularly past the outer wall of the outer housing in a first direction and the pivoting member includes a second extension member on the first side of the pivoting member extending the second peg groove perpendicularly past the outer wall of the outer housing in the first direction.

6. The locking device of claim 5, wherein the outer housing includes a third extension member on the second side of the outer housing extending the first peg groove out perpendicularly past the outer wall of the outer housing in a second direction and the pivoting member includes a fourth extension member on the second side of the pivoting member extending the second peg groove perpendicularly past the outer wall of the outer housing in the second direction, the second direction opposite to the first direction.

7. The locking device of claim 1, further comprising a barrel spring at least partially contained within the interior of the outer housing, the barrel spring configured to bias the cylindrical shell away from the first peg groove to an unlocked position where the at least a portion of the projection is not disposed through the first aperture.

8. The locking device of claim 7, wherein the outer housing includes a first slot and a second slot disposed in the interior wall of the outer housing, the second slot disposed closer to the interior walk of the outer housing than the first slot.

9. The locking device of claim 8, further comprising a plunger locking bolt movably mounted through a slot of the cylindrical shell, wherein the first slot receives the plunger locking bolt to maintain the at least a portion of the projection in the first aperture.

10. The locking device of claim 9, wherein the second slot receives the plunger locking bolt to maintain the projection in an unlocked position when the at least a portion of the projection is not disposed through the first aperture.

11. The locking device of claim 10, further comprising a second barrel spring configured to bias the plunger locking bolt towards the outer wall of the outer housing.

12. The locking device of claim 11, wherein the cylinder plug includes an engaging element disposed in a cavity of the plunger locking bolt, the engaging element drawing the plunger locking bolt away from the outer wall of the outer housing and toward the cylindrical shell when the cylinder plug is rotated.

13. The locking device of claim 1, wherein the barrel pin and the arced channel are configured to limit the range of rotation of the cylinder plug within the cylindrical shell.

14. The locking device of claim 1, wherein the hinging mechanism further comprises a first hinging element disposed on the outer housing and a second and third hinging element disposed on the pivoting member, the first hinging element is coupled to the second and third hinging element, the first hinging element disposed between the second and third hinging elements.

15. The locking device of claim 14, wherein the first and second hinging elements are coupled together by a first pin and the first and third hinging elements are coupled together by a second pin, the first pin partially disposed in a channel of the first hinging element and a channel of the second hinging element and the second pin partially disposed in the channel of the first hinging element and a channel of the third hinging element.

16. The locking device of claim 1, wherein the slot and the barrel pin are configured to limit the range of longitudinal motion of the cylindrical shell with respect to the outer housing.

17. The locking device of claim 1, wherein the locking device is configured to be locked onto at least one of a straight wire and a bent wire.

18. A locking device comprising:

an outer housing including an outer wall and a hollow cylindrical interior having a first longitudinal axis and an interior wall, the interior wall including a slot, the outer housing further including a first peg groove extending from a first side of the outer housing to a second side of the outer housing, the first side of the outer housing opposite to the second side of the outer housing, the first peg groove traversing the first longitudinal axis;

a cylindrical shell including a projection, the cylindrical shell being at least partially disposed in the interior of the outer housing and moveable within the interior along the first longitudinal axis;

a cylinder plug including a key hole and an arced channel, the cylinder plug contained within the cylindrical shell and rotatable relative to the cylindrical shell when a proper key is inserted in the key hole and rotated;

a barrel pin disposed through a wall of the cylindrical shell, such that a first portion of the barrel pin projects toward the interior of the cylindrical shell into the arced channel to rotatably retain the cylinder plug in the cylindrical shell, and a second portion of the barrel pin projects toward the exterior of the cylindrical shell into the slot to control the longitudinal motion of the cylindrical shell; and a pivoting member hingedly coupled to the outer housing by a hinging mechanism, the pivoting member including a second peg groove extending from a first side of the pivoting member to a second side of the pivoting member, the first side of the pivoting member opposite to the second side of the pivoting member, the pivoting member is pivoted about the hinging mechanism to achieve an open position relative to the outer housing or a closed position relative to the outer housing, wherein, in the closed position, the first peg groove is disposed adjacent to the second peg groove to form a channel extending from the first side of the outer housing and the first side of the pivoting member to the second side of the outer housing and the second side of the pivoting member, wherein the first peg groove is configured to receive a portion of a wire when the pivoting member is in the open position relative to the outer housing, the pivoting member is pivoted about the hinging mechanism to achieve the closed position relative to the outer housing enclosing the portion of the wire in the channel and the cylindrical shell is advanced along the first longitudinal axis such that the projection secures the pivoting member in the closed position to secure the wire in the channel.

19. A locking device comprising:

a housing having a first end and a second end, the first end including a hollow cylindrical interior having a first longitudinal axis along the housing and an interior wall, the interior wall including a slot, the second end including a groove traversing the first longitudinal axis, the groove configured to receive at least a portion of a wire;

a cylindrical shell including a projection, the cylindrical shell being at least partially disposed in the interior of the housing and moveable within the interior along the first longitudinal axis;

a cylinder plug including a key hole and an arced channel, the cylinder plug contained within the cylindrical shell and rotatable relative to the cylindrical shell when a proper key is inserted in the key hole and rotated;

a barrel pin disposed through a wall of the cylindrical shell, such that a first portion of the barrel pin projects toward the interior of the cylindrical shell into the arced channel to rotatably retain the cylinder plug in the cylindrical shell, and a second portion of the barrel pin projects toward the exterior of the cylindrical shell into the slot to control the longitudinal motion of the cylindrical shell; and a pivoting member hingedly coupled to the second end of the housing by a hinging mechanism, wherein in an open position, the pivoting member is spaced away from the groove, and in a closed position, the pivoting member is pivoted about the hinging mechanism enclosing the portion of the wire in the groove, wherein when the cylindrical shell is advanced along the longitudinal axis toward the second end of the housing, the projection secures the pivoting member in the closed position.

* * * * *